US011691790B2

(12) United States Patent
Dais et al.

(10) Patent No.: US 11,691,790 B2
(45) Date of Patent: Jul. 4, 2023

(54) STORAGE BAG WITH IMPROVED GRIPPING FEATURES

(71) Applicant: S.C. Johnson & Son, Inc., Racine, WI (US)

(72) Inventors: Brian C. Dais, Sanford, MI (US); Jose Porchia, Saginaw, MI (US); Daniel P. Zimmerman, Midland, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 35 days.

(21) Appl. No.: 16/252,163

(22) Filed: Jan. 18, 2019

(65) Prior Publication Data

US 2020/0231341 A1 Jul. 23, 2020

(51) Int. Cl.
*B65D 33/25* (2006.01)
*B65D 33/00* (2006.01)

(52) U.S. Cl.
CPC ..... *B65D 33/2566* (2013.01); *B65D 33/007* (2013.01)

(58) Field of Classification Search
CPC ..... B65D 33/25; B65D 33/2508; B65D 33/2516; B65D 33/2525; B65D 33/2533; B65D 33/2541; B65D 33/255; B65D 33/2558; B65D 33/2566; B65D 33/2575; B65D 33/2583; B65D 33/2591; B65D 33/2584; B65D 33/2858; B65D 33/2586;
(Continued)

(56) References Cited

U.S. PATENT DOCUMENTS 5,009,828 A * 4/1991 McCree ..... B65D 33/2508 156/244.11
5,369,847 A 12/1994 Naya et al.
(Continued)

FOREIGN PATENT DOCUMENTS

CN 102333704 A 1/2012
CN 104936863 A 9/2015
(Continued)

OTHER PUBLICATIONS

"Ziploc Brand Launches its Latest Innovation—Easy Open Tab Bags", Apr. 6, 2015, https://www.scjohnson.com/Press%20Releases/2015/April/Ziploc%20Brand%20Launches%20Latest%20Innovation%20Easy%20Open%20Tab%20Bags.com.
(Continued)

*Primary Examiner* — Jes F Pascua
*Assistant Examiner* — Nina K Attel

(57) ABSTRACT

A storage bag has first and second closure profiles adjacent to an opening of the bag. The first and second closure profiles are each provided with a closure member that extends along the length of the respective closure profile, with the closure member of the first closure profile being configured to engage with the closure member of the second closure profile to form a seal for the opening of the bag. The first closure profile further includes (a) a plurality of gripping ridges that extends from the closure member to the top edge of the first closure profile, and (b) a texture that extends in an area between the closure member and the top edge of the first closure profile, with the texture extending continuously (i) in the area between the closure member and the top edge of the first closure profile, and (ii) between each gripping ridge of the plurality of gripping ridges.

28 Claims, 19 Drawing Sheets

(58) Field of Classification Search
CPC ..... B65D 33/25865; B65D 33/2587; B65D 33/2588; B65D 33/2589; B65D 33/259; B65D 33/005; B65D 33/007
USPC ..... 383/61.2, 63, 64, 65
See application file for complete search history.

(56) References Cited

U.S. PATENT DOCUMENTS

| | | | |
|---|---|---|---|
| 6,231,235 | B1 | 5/2001 | Galomb et al. |
| 6,550,965 | B2 | 4/2003 | Shaffer et al. |
| 6,709,157 | B2 | 3/2004 | VandenHeuvel et al. |
| 7,137,736 | B2 | 11/2006 | Pawloski et al. |
| 7,438,473 | B2 | 10/2008 | Borchardt |
| 7,458,925 | B2 | 12/2008 | Turvey |
| 7,534,039 | B2 | 5/2009 | Wu |
| 7,585,111 | B2 | 9/2009 | Turvey et al. |
| 7,596,930 | B2 | 10/2009 | Borchardt |
| 7,651,271 | B2 | 1/2010 | Withers |
| 7,674,040 | B2 | 3/2010 | Dowd et al. |
| D613,615 | S | 4/2010 | Hedstrom |
| 7,798,714 | B2 | 9/2010 | Zimmerman et al. |
| 7,950,851 | B2 | 5/2011 | Taheri |
| 8,192,085 | B2 | 6/2012 | Pawloski et al. |
| 8,409,611 | B2 | 4/2013 | Wachtel et al. |
| 8,419,279 | B2 | 4/2013 | Borchardt |
| 8,469,592 | B2 | 6/2013 | Pawloski |
| 8,550,715 | B2 | 10/2013 | Anzini et al. |
| 8,550,716 | B2 | 10/2013 | Smith et al. |
| 8,578,572 | B2 | 11/2013 | Ackerman et al. |
| 8,603,609 | B2 | 12/2013 | Fraser et al. |
| 8,727,620 | B2 | 5/2014 | Dais et al. |
| 8,888,365 | B2 | 11/2014 | Fraser et al. |
| D723,386 | S | 3/2015 | Stark et al. |
| D723,937 | S | 3/2015 | Dais et al. |
| D723,939 | S | 3/2015 | Porchia et al. |
| D724,442 | S | 3/2015 | Burggren et al. |
| 9,050,783 | B2 | 6/2015 | Borchardt et al. |
| 9,114,914 | B2 | 8/2015 | Dais et al. |
| D748,990 | S | 2/2016 | Cisek et al. |
| D750,404 | S | 3/2016 | Cisek et al. |
| D750,499 | S | 3/2016 | Cisek et al. |
| D762,483 | S | 8/2016 | Cisek et al. |
| 9,540,145 | B2 | 1/2017 | Porchia et al. |
| 9,604,761 | B2 | 3/2017 | Dais et al. |
| 9,624,003 | B1 | 4/2017 | Tseng et al. |
| 9,637,276 | B2 | 5/2017 | Dais et al. |
| 9,637,277 | B2 | 5/2017 | Porchia et al. |
| D788,599 | S | 6/2017 | Stark et al. |
| 9,669,595 | B2 | 6/2017 | Borchardt et al. |
| 9,682,801 | B2 | 6/2017 | Borchardt et al. |
| 9,738,422 | B2 | 8/2017 | Ackerman et al. |
| 9,790,002 | B2 | 10/2017 | Tseng et al. |
| D807,198 | S | 1/2018 | Porchia et al. |
| D811,895 | S | 3/2018 | Melvan et al. |
| D811,900 | S | 3/2018 | Cisek et al. |
| D812,492 | S | 3/2018 | Cisek et al. |
| D814,940 | S | 4/2018 | Pszczolkowski et al. |
| 9,932,150 | B2 | 4/2018 | Tseng et al. |
| 9,950,841 | B2 | 4/2018 | Fraser et al. |
| D817,779 | S | 5/2018 | Pszczolkowski et al. |
| D824,780 | S | 8/2018 | Tseng et al. |
| 10,046,508 | B2 | 8/2018 | Dorsey et al. |
| 10,099,818 | B2 | 10/2018 | Sprehe |
| 2003/0138171 | A1 | 6/2003 | Kikuchi |
| 2004/0078939 | A1 | 4/2004 | Pawloski |
| 2005/0281489 | A1 | 12/2005 | Yeh et al. |
| 2005/0281492 | A1 | 12/2005 | Turvey et al. |
| 2006/0104548 | A1 | 5/2006 | Schreiter |
| 2006/0188180 | A1 | 8/2006 | Otsubo |
| 2007/0172157 | A1 | 7/2007 | Buchman |
| 2007/0178157 | A1 | 8/2007 | Wachtel et al. |
| 2007/0206888 | A1 | 9/2007 | Chang |
| 2007/0280563 | A1 | 12/2007 | Ausnit |
| 2008/0105679 | A1 | 5/2008 | Ballard |
| 2008/0226203 | A1 | 9/2008 | Dais et al. |
| 2011/0044565 | A1* | 2/2011 | Pawloski ..... B65D 33/2558 383/63 |
| 2011/0044566 | A1 | 2/2011 | Fish et al. |
| 2011/0052105 | A1 | 3/2011 | Wilcoxen et al. |
| 2011/0311169 | A1* | 12/2011 | Smith ..... B65D 33/255 383/63 |
| 2013/0195384 | A1 | 8/2013 | Dais et al. |
| 2013/0236129 | A1 | 9/2013 | Pawloski |
| 2014/0056545 | A1* | 2/2014 | Fish ..... B65D 33/007 383/210 |
| 2014/0093193 | A1 | 4/2014 | Dais et al. |
| 2014/0093195 | A1 | 4/2014 | Dais et al. |
| 2014/0153846 | A1 | 6/2014 | Dais et al. |
| 2014/0205214 | A1 | 7/2014 | Dais et al. |
| 2014/0205215 | A1 | 7/2014 | Dais et al. |
| 2014/0216969 | A1 | 8/2014 | Cherian |
| 2016/0122086 | A1 | 5/2016 | Sprehe |
| 2016/0221723 | A1 | 8/2016 | Tseng et al. |
| 2017/0233141 | A1* | 8/2017 | Dais ..... B65D 33/28 383/65 |
| 2018/0029754 | A1 | 2/2018 | Tseng et al. |
| 2018/0029755 | A1 | 2/2018 | Tseng et al. |

FOREIGN PATENT DOCUMENTS

| | | | |
|---|---|---|---|
| DM | 091 821 | | 3/2016 |
| EM | 000008974-0001 | | 6/2003 |
| EM | 001306468-0001 | | 3/2012 |
| EM | 001306468-0002 | | 3/2012 |
| EM | 002565150-0001 | | 10/2014 |
| EM | 002565150-0002 | | 10/2014 |
| EM | 002309724-0012 | | 5/2015 |
| EM | 002309724-0014 | | 5/2015 |
| EM | 002309724-0015 | | 5/2015 |
| EM | 002309724-0017 | | 5/2015 |
| EM | 002309724-0020 | | 5/2015 |
| EM | 002309724-0021 | | 5/2015 |
| EP | 89680 | A2 * | 3/1983 |
| EP | 0089680 | A2 * | 3/1983 |
| EP | 3446760 | A1 | 9/1991 |
| JP | 2005035663 | A | 2/2005 |
| JP | 2009241949 | A | 10/2009 |
| WO | 00/76871 | A1 | 12/2000 |
| WO | 02/34634 | A1 | 5/2002 |
| WO | 02/098642 | A1 | 12/2002 |
| WO | 2006/012228 | A2 | 2/2006 |
| WO | 2006/021564 | A1 | 3/2006 |
| WO | 2009/108078 | A2 | 9/2009 |
| WO | 2013009267 | A1 | 1/2013 |
| WO | 2013/062812 | A1 | 5/2013 |
| WO | 2014/052582 | A2 | 4/2014 |

OTHER PUBLICATIONS

Notification of and International Search Report and Written Opinion dated Dec. 13, 2019, in corresponding International Patent Application No. PCT/US2019/054697.
Chinese Office Action dated Jul. 25, 2022, issued in corresponding Chinese Patent Application No. 202111008361.7 (with English translation), 11 pages.
Office Action dated Aug. 15, 2022, in Japanese Patent Application No. 2021-131499 (9 pages).
Office Action dated Aug. 15, 2022, in Japanese Patent Application No. 2021-541034 (9 pages).
Office Action dated Oct. 10, 2022, in Australian Patent Application No. 2019423279 (3 pages).
Office Action dated Oct. 14, 2022, in Canadian Patent Application No. 3,121,185 (5 pages).
First Office Action, in Chinese Patent Application No. 2019-80089573.7 (with English Translation), dated Jun. 20, 2022.
Brazilian Office Action dated Mar. 14, 2023, issued in corresponding Brazilian Patent Application No. BR112021014047-6 (with English translation), 7 pages.

* cited by examiner

STORAGE BAG WITH IMPROVED GRIPPING FEATURES

BACKGROUND

Field of the Invention

Our invention relates to a storage bag. More specifically, our invention relates to a storage bag with features that facilitate sealing and unsealing the bag, as well as a storage bag that includes features that improve gripping of the bag by a user.

Related Art

Storage bags made from flexible plastic materials are well known. Such storage bags are made in a variety of sizes, and can be used to contain a variety of items, including food, utensils, clothing, tools, etc. Such storage bags often include some type of zipper-like closure mechanism to releasably seal the interior of the bag. Plastic storage bags with closure mechanisms are sold by the assignee of the present application under the ZIPLOC® trademark.

The closure mechanisms of plastic storage bags often include two interlocking structures that are provided on or near lips at the top of the bag. In order to seal the closure mechanism, a user will run his or her fingers along the closure mechanism, squeezing the interlocking members together. It is often easier to cause the interlocking members to become fully engaged throughout their length if the operation is performed in a certain manner, although a user may not necessarily be aware of the proper technique for performing the operation.

To open the bag, the user grasps the lips, and pulls the interlocking structures apart. Plastic storage bags, however, usually have slick surfaces that are difficult to grasp. Moreover, it is often easier to pull the interlocking structures apart if the bag is grasped in certain areas, and a certain motion is applied to the interlocking members. As with sealing the bag, however, a user may not necessarily be aware of the proper technique to unseal the bag.

Due to their vast functionality, storage bags are often used to contain different products, such as liquids, gels, food products, cosmetics, etc. Depending on the product, however, plastic storage bags can become wet, slimy, or otherwise hard for the user to handle. It would be beneficial, therefore, to provide storage bags with features for making the storage bags easier to seal and to unseal. Further, it would be beneficial to provide storage bags with features that improve the ability of the user to grip the bag during sealing and unsealing.

SUMMARY OF THE INVENTION

According to one aspect, our invention provides a storage bag that includes a first side surface and a second side surface connected to the first side surface so as to form an interior of the bag with an opening to the interior. A first closure profile is connected to the first side surface and positioned adjacent to the opening of the bag. The first closure profile has a top edge and includes a closure member that extends along the length of the first closure profile between a first side of the first closure profile and a second side of the first closure profile. The first closure profile further includes (a) a plurality of gripping ridges that extends from the closure member to the top edge of the first closure profile, and (b) a texture that extends in an area between the closure member and the top edge of the first closure profile, with the texture extending continuously (i) in the area between the closure member and the top edge of the first closure profile, and (ii) between each gripping ridge of the plurality of gripping ridges. A second closure profile is connected to the second side surface and positioned adjacent to the opening of the bag. The second closure profile has a top edge and includes a closure member that extends along at least the length of the second closure profile between a first side of the second closure profile and a second side of the second closure profile, with the closure member being configured to engage with the closure member of the first closure profile to form a seal for the opening of the bag.

According to another aspect, our invention provides a storage bag with a first side surface and a second side surface connected to the first side surface so as to form an interior of the bag with an opening to the interior. A first closure profile is connected to the first side surface and positioned adjacent to the opening of the bag. The first closure profile has a top edge and includes a closure member that extends along the length of the first closure profile between a first side of the first closure profile and a second side of the first closure profile. The first closure profile further forms a lip between the closure member and the top edge of the first closure profile, with the lip including (a) a plurality of gripping ridges that extends from the closure member to the top edge of the first closure profile, and (b) a texture that extends in an area between the closure member and the top edge of the first closure profile, with the texture extending continuously (i) in the area between the closure member and the top edge of the first closure profile, and (ii) between each gripping ridge of the plurality of gripping ridges. A second closure profile is connected to the second side surface and positioned adjacent to the opening of the bag. The second closure profile has a top edge and includes a closure member that extends along at least the length of the second closure profile between a first side of the second closure profile and a second side of the second closure profile, with the closure member being configured to engage with the closure member of the first closure profile to form a seal for the opening of the bag. The second closure profile further forms a lip between the closure member and the top edge of the second closure profile, with the lip including (a) a plurality of gripping ridges that extends from the closure member to the top edge of the second closure profile, and (b) a texture that extends in an area between the closure member and the top edge of the second closure profile, with the texture extending continuously (i) in the area between the closure member and the top edge of the second closure profile, and (ii) between each gripping ridge of the plurality of gripping ridges.

According to yet another aspect, our invention provides a storage bag with a first side surface and a second side surface connected to the first side surface so as to form an interior of the bag with an opening to the interior. A first closure profile is connected to the first side surface and positioned adjacent to the opening of the bag. The first closure profile has a top edge and includes (a) a closure member and (b) a texture that extends in an area between the closure member and the top edge of the first closure profile, with the texture comprising a plurality of raised features having between about 95 and about 500 contact points per square inch of the first closure profile. A second closure profile is connected to the second side surface and positioned adjacent to the opening of the bag. The second closure profile has a top edge and includes a closure member that is configured to engage with the closure member of the first closure profile to form a seal for the opening of the bag.

According to another aspect, our invention provides a storage bag with a first side surface and a second side surface connected to the first side surface so as to form an interior of the bag with an opening to the interior. A first closure profile is connected to the first side surface and positioned adjacent to the opening of the bag, the first closure profile having a top edge and including a closure member. A second closure profile is connected to the second side surface and positioned adjacent to the opening of the bag. The second closure profile has a top edge and includes (a) a closure member that is configured to engage with the closure member of the first closure profile to form a seal for the opening of the bag, and (b) a texture that extends in an area between the closure member and the top edge of the second closure profile, with the texture comprising a plurality of raised features. Each raised feature of the plurality of raised features (i) is spaced a distance S1 from an adjacent raised feature along the length of the second closure profile from a first side to a second side of the second closure profile, with the distance S1 being between about 0.045 inches and about 0.100 inches, (ii) is spaced a distance S2 from an adjacent raised feature along the height of the second closure profile from the closure member to the top edge of the second closure profile, with the distance S2 being between about 0.045 inches and about 0.100 inches, and (iii) extends a height that is between about 2 mils and about 8 mils.

DETAILED DESCRIPTION OF THE INVENTION

Our invention relates to a plastic storage bag that includes features that facilitate sealing and unsealing of the bag. Our invention also relates to a storage bag that includes features that improve the ability of the user to grip the bag during sealing and unsealing. The features of our invention thereby provide for an easy to use and easy to grip plastic storage bag.

As will be apparent from the description herein, the term "bag" encompasses a broad range of structures designed to contain items, such as pouches, envelopes, packets, and the like. In general, the term bag, as used herein, simply means a somewhat flexible container with an opening, with the bag being capable of carrying any number of items.

Figure 1A:
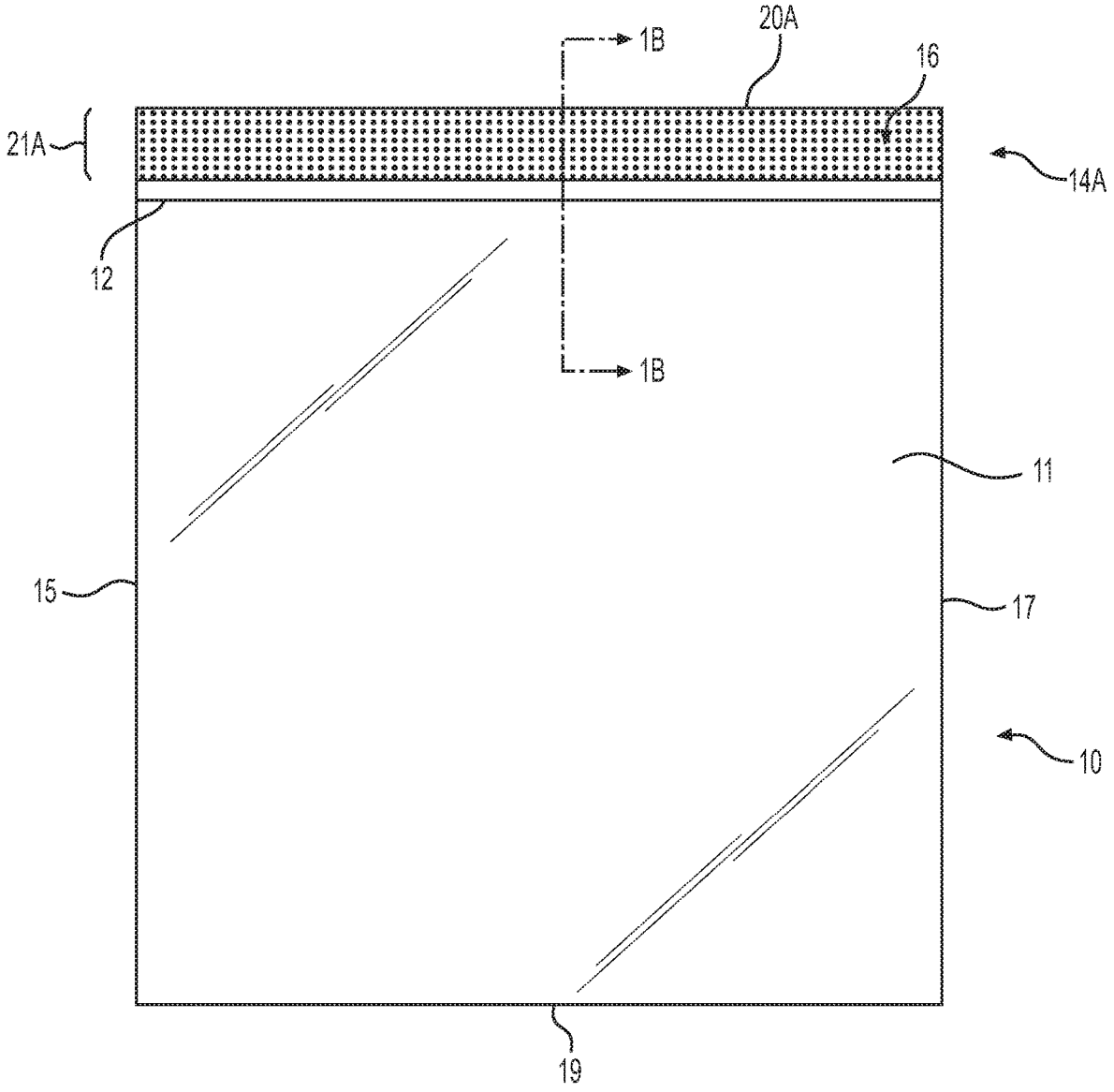
FIG. 1A is a side view of a bag according to an embodiment of the invention.
Figure 1B:
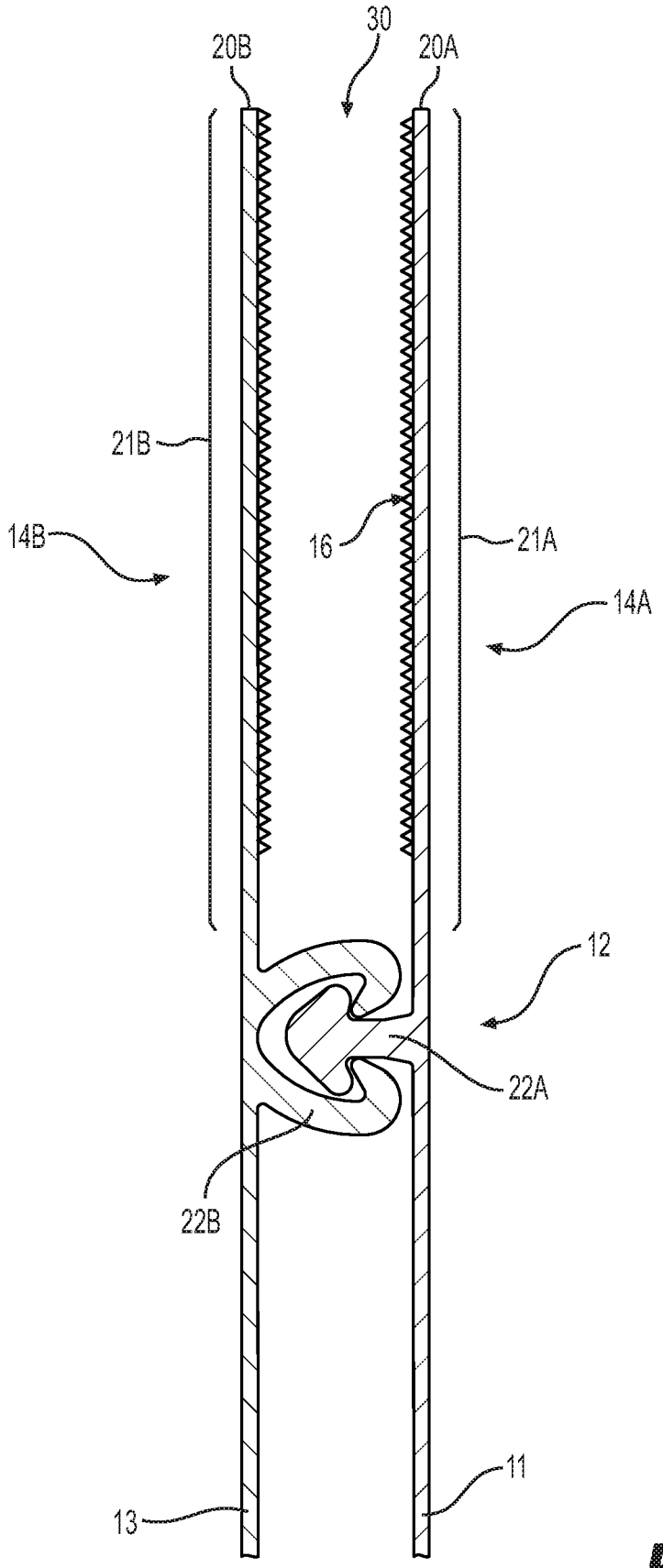
FIG. 1B is a cross-sectional view of the top end of the bag shown in FIG. 1A as taken along line 1B-1B.

FIGS. 1A and 1B are views of a bag 10 according to an embodiment of the invention. The bag 10 includes a first side surface 11 and a second side surface 13. The first and second side surfaces 11 and 13 are connected along edges 15 and 17, and the first and second side surfaces 11 and 13 are also connected at a bottom edge 19 of the bag 10. According to one embodiment, the bottom edge 19 can comprise a folded edge. An opening 30 to the interior of the bag 10 is formed adjacent to top edges 20A and 20B that are defined by closure profiles 14A and 14B, as will be described below. The first and second side surfaces 11 and 13 may be made from a substantially transparent plastic, such as the plastics discussed below, thereby allowing the contents of the interior of the bag to be easily determined. Alternatively, the first and second side surfaces 11 and 13 can be made substantially opaque, or of a completely opaque material.

In some embodiments, the side surfaces 11 and 13 are directly connected together at the edges 15, 17, and 19. The side surfaces 11 and 13 may be, for example, laminated together at the edges 15, 17, and 19. In other embodiments, however, additional surfaces may be provided to connect the first and second side surfaces 11 and 13. For example, a gusset-type connection may be formed at the edges 15, 17, and 19 between the first and second side surfaces 11 and 13, thereby allowing the first and second side surfaces 11 and 13 to be moved apart to an expanded bag configuration. Along these lines, it should be noted that the term "connected," as used herein, is generally a term that describes two structures that are directly attached to one another, but also encompasses structures that are connected through intermediary structures.

First and second closure profiles 14A and 14B form the top portion of the bag 10, with the closure profiles 14A and 14B also defining the top edges 20A and 20B of the bag 10. The closure profiles 14A and 14B include at least one closure mechanism, including, for example, at least one zipper profile 12. The zipper profile 12, preferably, extends along each of the first side surface 11 and the second side surface 13, from one of the edges 15 to a second of the edges 17. The zipper profile 12 comprises at least one pair of closure or interlocking members (see, e.g., elements 22A and 22B of FIG. 1B) for sealing the opening 30 of the bag 10. As shown in FIG. 1B, the first interlocking member 22A of the zipper profile 12 extends from the first closure profile 14A, and the second interlocking member 22B of the zipper profile 12 extends from the second closure profile 14B at a position opposite to the first interlocking member 22A. The interlocking members 22A and 22B can be interlocked and unlocked, with the interlocking member 22A being a male-type profile that is received by the female-type interlocking member 22B. Such interlocking of the interlocking members 22A and 22B will also be referred to herein as "occluding." Interlocking members such as those depicted in FIG. 1B are often referred to as zippers, as is known in the art. Examples of different shapes and configurations of such interlocking members and/or closure members that could be used with the storage bag disclosed herein can be seen in U.S. Pat. Nos. 5,070,584; 7,784,160; 7,886,412; 7,946,766; and 8,061,898, and in U.S. Patent Application Publication No. 2009/0324141, the disclosures of which are incorporated by reference herein in their entirety. Alternatively, the closure mechanism for the storage bag could comprise, for example, a pair of closure members that are sealed via a slider. In another embodiment, the closure mechanism could comprise, for example, an adhesive closure, a magnetic closure, a hook and loop fastener (e.g., a VELCRO® Brand type of closure), a micromechanical closure comprising a plurality of small interlocking members, and/or any other means for closing the top end of the storage bag.

The bag 10 is sealed by a user squeezing the first interlocking member 22A together with the second interlocking member 22B. It has been found that a user can most easily perform this process by starting at the ends of the zipper profile 12 (or interlocking members 22A and 22B), and then moving his or her fingers across the length of the bag. When unsealing the bag 10, the interlocking members 22A and 22B of the zipper profile 12 are pulled apart by the user grasping lips 21A and 21B of the bag and moving the closure profiles 14A and 14B apart. As will be discussed below, it is generally easier for a user to move the closure profiles 14A and 14B apart and unseal the interlocking members 22A and 22B, if a texture 16 is provided to a surface of the lips 21A and 21B of the bag 10.

The interlocking members 22A and 22B may be configured to provide an audible sound and/or a tactile sensation when engaging each other. A variety of techniques are known for providing such audible and tactile features, with one example being the provision of indentations intermittently along the length of the profiles of interlocking members 22A and 22B, or, more generally, making the interlocking members 22A and 22B discontinuous along their lengths. The indentions or structural discontinuities cause the interlocking members 22A and 22B to close together with a vibratory or bumpy feel, or with an audible clicking sound, or with both a bumpy feel and an audible clicking sound. An example of providing the interlocking members of a bag with audible or tactile features can be found in U.S. Pat. No. 5,140,727, the disclosure of which is incorporated by reference herein in its entirety.

It should be noted that, although the bag 10 described with regard to FIGS. 1A and 1B includes a single pair of interlocking members 22A and 22B, other embodiments of the bag can include two pairs of closure members and/or interlocking members, i.e., a pair of interlocking members extending from the first closure profile of the bag that can connect to a pair of interlocking members extending from the second closure profile of the bag. Still other embodiments can include more than two pairs of closure members and/or interlocking members. It should also be noted that the interlocking members 22A and 22B do not necessarily need to fully extend to the edges of the bag 10. For example, in some embodiments, the bag 10 may include extended sealed sections at the edges 15 and 17 of the bag 10, with the interlocking 22A and 22B configured to extend only from one sealed section to the other, and not all the way to the edges 15 and 17 of the bag 10. In this regard, references herein to the interlocking members 22A and 22B "extending between" the sides of the closure profiles 14A and 14B do not necessarily indicate that the interlocking members 22A and 22B extend all the way to edges 15 and 17 of the closure profiles 14A and 14B.

The closure profiles 14A and 14B also form lips 21A and 21B that extend from the at least one zipper profile 12 to the respective top edge 20A and 20B of the bag 10. In addition, as shown in FIGS. 1A and 1B, one or both of the surfaces of the lips 21A and 21B includes a texture 16. The texture 16 facilitates gripping of the lips 21A and 21B, and hence, opening of the bag 10. Such a texture 16 may easily be formed on one or both of the surfaces of the lips 21A and 21B using a variety of techniques, with one example being embossing. Other techniques include ultrasonic forming, blasting with sand or water jets to abrade the surface, heating patterns, laser ablations, a textured casting roll, and removing portions of the substrate in the lip area. In addition, the texture 16 can be provided to (i) either the interior or exterior surface of one of the lips 21A or 21B, (ii) either the interior or exterior surface of both of the lips 21A and 21B, (iii) both the interior and exterior surface of one of the lips 21A or 21B, (iv) both the interior and exterior surface of both of the lips 21A and 21B, or (v) any combination thereof. Further, the texture 16 can extend in an area directly adjacent to the closure profiles 14A and 14B to the respective top edge 20A and 20B, or in an area that is spaced from the closure profiles 14A and 14B to the respective top edge 20A and 20B. The texture 16 can also be provided continuously across one or both of the surfaces of the lips 21A and 21B, or in one or more portions of one or both of the surfaces of the lips 21A and 21B. As will be described in more detail below with regard to FIGS. 5A to 5J, various patterns can be used for the texture 16 to be provided to at least one of the surfaces of at least one of the lips 21A and 21B. The texture 16 improves the grippability of the lips 21A and 21B by providing effective gripping surfaces that a user can easily grasp when unsealing the interlocking members 22A and 22B. The texture 16 can also assist a user when sealing the interlocking members 22A and 22B, by providing improved grippability at the end(s) of the bag, as well as a tactile feedback to the user as the interlocking members 22A and 22B are being sealed. Additionally, the texture 16 provides a feedback to a consumer, in the form of, for example, a visual and/or tactile cue for locating the lips 21A and 21B of the bag 10. Moreover, as will also be described in more detail below, the texture 16 can be provided in combination with gripping ridges 18 that further improve the grippability of the lips 21A and 21B (see, e.g., FIGS. 2A, 2B, 6A, and 7).

The first and second side surfaces 11 and 13, as well as the first and second closure profiles 14A and 14B, including the lips 21A and 21B, may be formed from thermoplastic materials, and by known processes that are well known in the art. For example, the side surfaces 11 and 13 may be independently extruded of thermoplastic material as a single continuous or multi-ply web, and the closure profiles 14A and 14B (including the lips 21A and 21B) may be extruded of the same or different thermoplastic materials separately as continuous lengths or strands. The first and second closure profiles 14A and 14B (including the lips 21A and 21B) may be integrally formed with (and thus "connected") to the side surfaces 11 and 13 of the bag 10. Alternatively, the first and second closure profiles 14A and 14B (including the lips 21A and 21B) may be formed as separate structures that are attached (and thus "connected") to the first and second side walls or surfaces 11 and 13, for example, by laminating the first and second closure profiles 14A and 14B (including the lips 21A and 21B) to the first and second side walls or surfaces 11 and 13.

Illustrative thermoplastic materials that could be used to form the bag 10 include, for example, polypropylene (PP), polyethylene (PE), metallocene-polyethylene (mPE), low density polyethylene (LDPE), linear low density polyethylene (LLDPE), ultra low density polyethylene (ULDPE), biaxially-oriented polyethylene terephthalate (BPET), high density polyethylene (HDPE), polyethylene terephthalate (PET), among other polyolefin plastomers and combinations and blends thereof. Still other materials that may be used include styrenic block copolymers, polyolefin blends, elastomeric alloys, thermoplastic polyurethanes, thermoplastic copolyesters, thermoplastic polyamides, polymers and copolymers of polyvinyl chloride (PVC), polyvinylidene chloride (PVDC), saran polymers, ethylene/vinyl acetate copolymers, cellulose acetates, polyethylene terephthalate (PET), ionomer, polystyrene, polycarbonates, styrene acryloacrylonitrile, aromatic polyesters, linear polyesters, and thermoplastic polyvinyl alcohols. Further materials that could be used for the bag 10 include, for example, paper, bio-based materials (i.e., synthetic materials that consist of partially or completely renewable raw materials), such as, for example, bio-based polyethylene or another bio-based resin, post-consumer recycle resins, compostable resins, such as polyhydroxyalkanoates (PHA), polybutylene adipate terephthalate (PBAT), polycaprolactone (PCL), polylactic acid (PLA), etc., and combinations and blends thereof. Those skilled in the art will recognize that a wide variety of other materials may also be used to form the bag 10.

FIGS. 2A-3B are views of a bag 10' according to another embodiment of the invention. The bag 10' is configured similar to the bag 10 described above, with the exception of the first and second closure profiles 14A' and 14B' including (i) at least two closure mechanisms, including, for example, at least two zipper profiles 12A and 12B and (ii) gripping ridges 18 along with the texture 16 discussed above. The zipper profiles 12A and 12B, preferably, both extend along each of the first side surface 11 and the second side surface 13, from one of the edges 15 to a second of the edges 17. The zipper profiles 12A and 12B each comprises at least one pair of closure members or interlocking members (see, e.g., elements 22A, 22B, 22C, and 22D of FIG. 2B) for sealing the opening 30 of the bag 10'. As shown in FIG. 2B, the first interlocking member 22A of the upper zipper profile 12A extends from the first closure profile 14A', and the second interlocking member 22B of the upper zipper profile 12A extends from the second closure profile 14B' at a position opposite to the first interlocking member 22A. As also shown in FIG. 2B, a third interlocking member 22C of the lower zipper profile 12B extends from the first closure profile 14A', and a fourth interlocking member 22D of the lower zipper profile 12B extends from the second closure profile 14B' at a position opposite to the third interlocking member 22C. The interlocking members 22A, 22B, 22C, and 22D can be interlocked and unlocked, with the interlocking members 22A and 22D being a male-type profile that is received by the female-type interlocking members 22B and 22C. Such interlocking of the interlocking members 22A, 22B, 22C, and 22D will also be referred to herein as "occluding." As discussed above, interlocking members such as those depicted in FIG. 2B are often referred to as zippers, as is known in the art. Examples of different shapes and configurations of such interlocking members and/or closure members that could be used with the storage bag disclosed herein can be seen in U.S. Pat. Nos. 5,070,584; 7,784,160; 7,886,412; 7,946,766; and 8,061,898, and in U.S. Patent Application Publication No. 2009/0324141, the disclosures of which are incorporated by reference herein in their entirety. Alternatively, the closure mechanism for the storage bag could comprise, for example, a pair of closure members that are sealed via a slider. In another embodiment, the closure mechanism could comprise, for example, an adhesive closure, a magnetic closure, a hook and loop fastener (e.g., a VELCRO® Brand type of closure), a micromechanical closure comprising a plurality of small interlocking members, and/or any other means for closing the top end of the storage bag.

It should be noted that, although the bag 10' described herein includes two pairs of interlocking members 22A, 22B, 22C, and 22D, other embodiments of the bag can include only one pair of closure members and/or interlocking members, i.e., a single interlocking member extending from the first closure profile of the bag that can connect to an interlocking member extending from the second closure profile of the bag (see, e.g., FIG. 1A). Still other embodiments can include more than two pairs of closure members and/or interlocking members. As also noted above, the interlocking members 22A, 22B, 22C, and 22D do not necessarily need to fully extend to the edges of the bag 10'. For example, in some embodiments, the bag 10' may include extended sealed sections at the edges 15 and 17 of the bag 10', with the interlocking members 22A, 22B, 22C, and 22D configured to extend only from one sealed section to the other, and not all the way to the edges 15 and 17 of the bag 10'. In this regard, references herein to the interlocking members 22A, 22B, 22C, and 22D "extending between" the sides of the closure profiles 14A' and 14B' do not necessarily indicate that the interlocking members 22A, 22B, 22C, and 22D extend all the way to edges 15 and 17 of the closure profiles 14A' and 14B'.

Figure 2A:
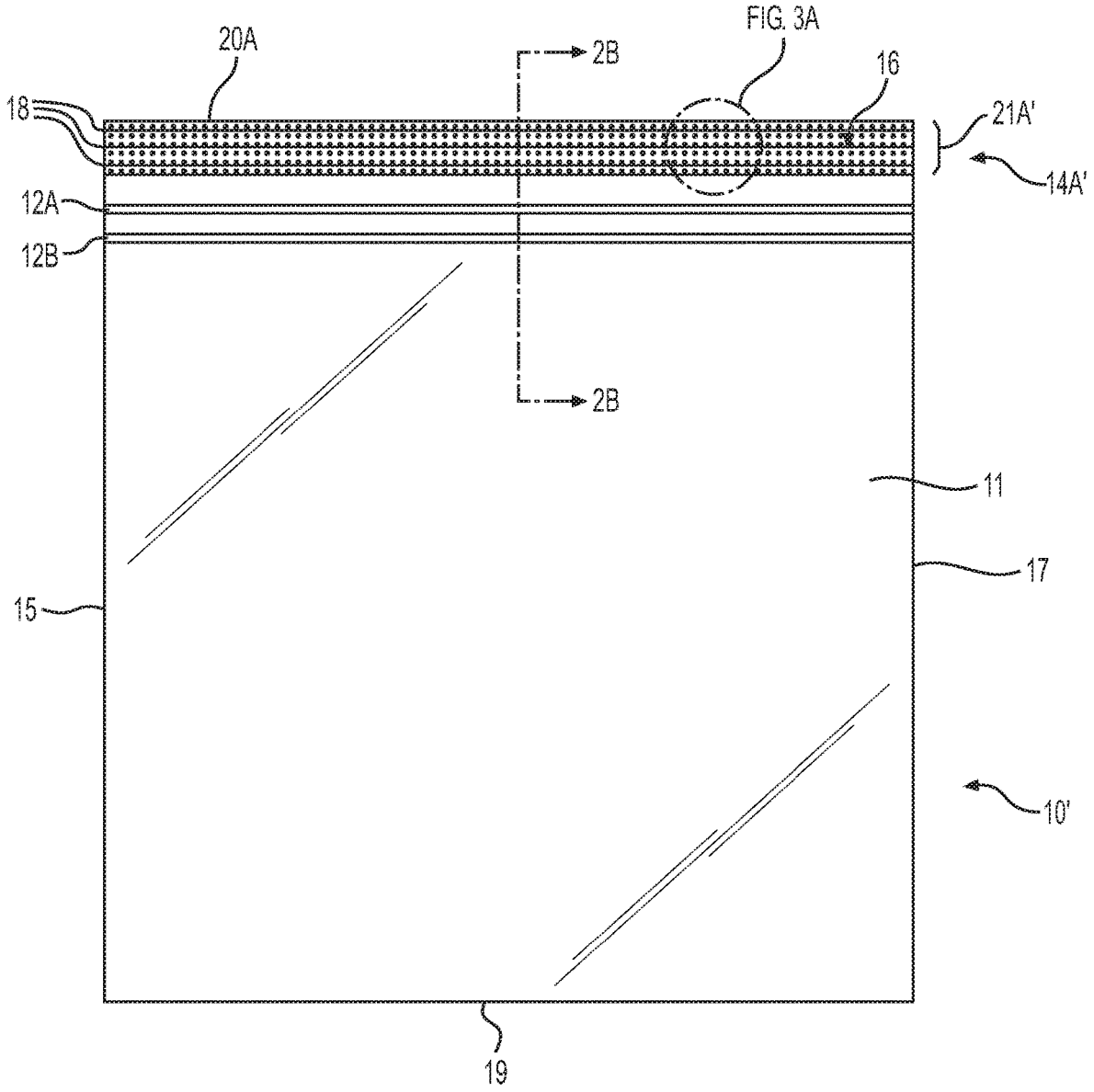
FIG. 2A is a side view of a bag according to another embodiment of the invention.
Figure 2B:
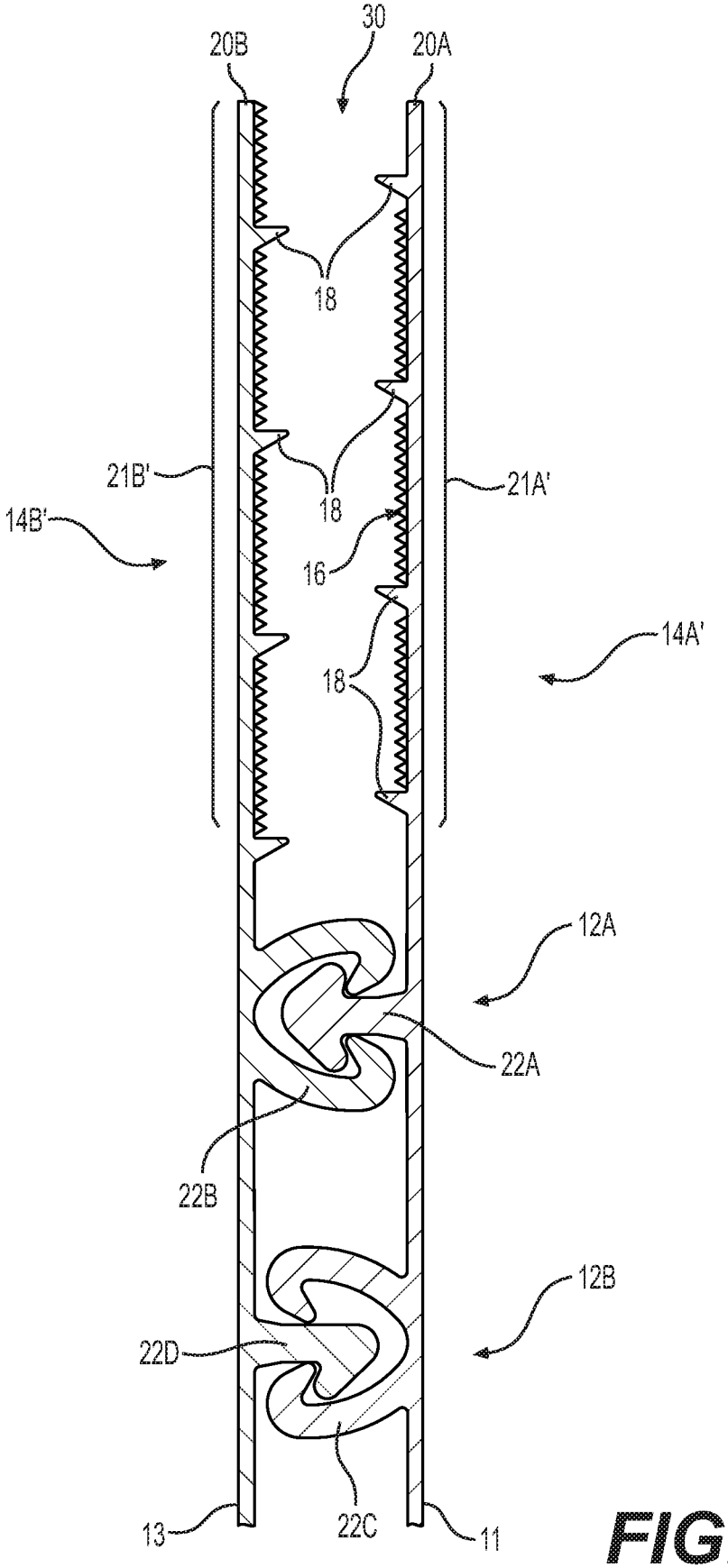
FIG. 2B is a cross-sectional view of the top end of the bag shown in FIG. 2A as taken along line 2B-2B.

Similar to the bag 10 described above, the closure profiles 14A' and 14B' of the bag 10' also form lips 21A' and 21B' that extend from the at least two zipper profiles 12A and 12B to the respective top edge 20A and 20B of the bag 10'. In addition, as shown in FIGS. 2A and 2B, one or both of the surfaces of the lips 21A' and 21B' includes a texture 16. As discussed above, the texture 16 facilitates gripping of the lips 21A' and 21B', and hence, opening of the bag 10'. Such a texture 16 may easily be formed on one or both of the surfaces of the lips 21A' and 21B' using a variety of techniques, with one example being embossing. Other techniques include ultrasonic forming, blasting with sand or water jets to abrade the surface, heating patterns, laser ablations, a textured casting roll, and removing portions of the substrate in the lip area. In addition, the texture 16 can be provided to (i) either the interior or exterior surface of one of the lips 21A' or 21B', (ii) either the interior or exterior surface of both of the lips 21A' and 21B', (iii) both the interior and exterior surface of one of the lips 21A' or 21B', (iv) both the interior and exterior surface of both of the lips 21A' and 21B', or (v) any combination thereof. Further, the texture 16 can extend in an area directly adjacent to the closure profiles 14A' and 14B' to the respective top edge 20A and 20B, or in an area that is spaced from the closure profiles 14A' and 14B' to the respective top edge 20A and 20B. The texture 16 can also be provided continuously across one or both of the surfaces of the lips 21A' and 21B', or in one or more portions of one or both of the surfaces of the lips 21A' and 21B'. As will be described in more detail below with regard to FIGS. 5A to 5J, various patterns can be used for the texture 16 to be provided to at least one of the surfaces of at least one of the lips 21A' and 21B'.

In addition to the texture 16 that is provided to at least one of the surfaces of at least one of the lips 21A' and 21B', gripping ridges 18 are also provided that further improve the grippability of the lips 21A' and 21B' (see, e.g., FIGS. 2A and 2B). In the embodiment of FIGS. 2A and 2B, gripping ridges 18 are provided to the interior surface of both of the lips 21A' and 21B'. As shown in FIG. 2B, each of the gripping ridges 18 is spaced apart from another gripping ridge 18, with the texture 16 continuing between each of the gripping ridges 18. Although the embodiment of FIG. 2B illustrates gripping ridges 18 being provided to the interior surfaces of both of the lips 21A' and 21B', the gripping ridges 18 could alternatively be provided to (i) either the interior or exterior surface of one of the lips 21A' or 21B', (ii) either the interior or exterior surface of both of the lips 21A' and 21B', (iii) both the interior and exterior surface of one of the lips 21A' or 21B', (iv) both the interior and exterior surface of both of the lips 21A' and 21B', or (v) any combination thereof. In addition, any number of gripping ridges 18 can be added to the inside and/or outside of the lips 21A' and 21B'. As discussed in more detail below, the combination of the texture 16 and the gripping ridges 18 further improves the grippability of the lips 21A' and 21B' by providing particularly effective gripping surfaces that a user can easily grasp when unsealing the interlocking members 22A, 22B, 22C, and 22D. The texture 16 and/or gripping ridges 18 can also assist a user when sealing the interlocking members 22A, 22B, 22C, and 22D, by providing improved grippability at the end(s) of the bag, as well as a tactile feedback to the user as the interlocking members 22A, 22B, 22C, and 22D are being sealed. Additionally, the texture 16 and/or gripping ridges 18 provide a feedback to a consumer, in the form of, for example, a visual and/or tactile cue for locating the lips 21A' and 21B' of the bag 10'.

Figure 3A:
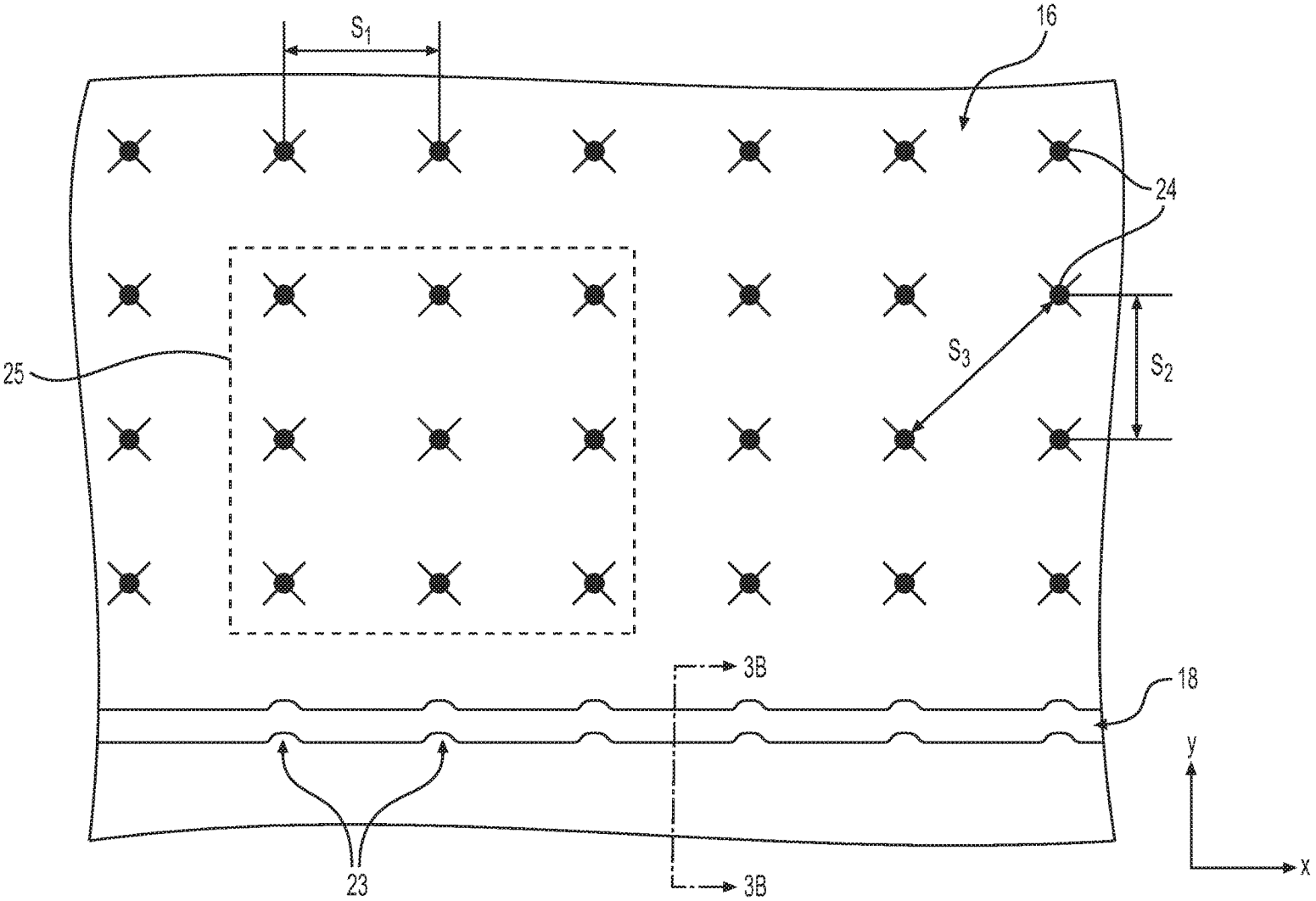
FIG. 3A is a partial view of the top end of the bag shown in FIG. 2A, of the area in circle 3A.

FIG. 3A illustrates a plan view of the top end of the bag 10' that is cut out of the lip 21A' of FIG. 2A to show a detailed view of the texture 16 and one of the gripping ridges 18. As shown in FIG. 3A, the texture 16 comprises a plurality of raised elements 24, with each of the raised elements 24 being spaced a distance S1 from an adjacent raised element 24 in the x-direction, i.e., the direction along the length of the bag between the first side edge 15 and the second side edge 17. Each of the raised elements 24 is also spaced a distance S2 from an adjacent raised element 24 in the y-direction, i.e., the direction along the height of the bag that extends between the bottom edge 19 and the respective top edge 20A and 20B. According to the embodiment of FIG. 3A, the distance S1 is substantially equal to the distance S2. The distance S1, however, can be different from the distance S2. According to one embodiment, the spacing between each of the raised elements 24 in either the x-direction (i.e., the distance S1) and/or the y-direction (i.e., the distance S2) is generally between about 0.045 inches to about 0.100 inches, and is, preferably, between about 0.053 inches and about 0.080 inches, and is, most preferably, between about 0.056 inches and about 0.070 inches. In particular, the inventors have found that a spacing between each of the raised elements 24 (i.e., a distance S1 and/or a distance S2) in the range of about 0.056 inches to about 0.070 inches, including a most preferred spacing (i.e., a distance S1 and/or a distance S2) of about 0.06 inches, is critical to the feel of the texture 16 to the user. In this regard, too dense of a texture 16, i.e., a spacing between each of the raised elements 24 (i.e., a distance S1 and/or a distance S2) of less than 0.045 inches can cause the user to lose the feeling or sensation of the texture 16, while too broad of a texture 16, i.e., a spacing between each of the raised elements 24 (i.e., a distance S1 and/or a distance S2) of greater than 0.100 inches can cause the user to feel a more needle-like sensation that is not desirable to the user. Accordingly, a spacing between each of the raised elements 24 (i.e., a distance S1 and/or a distance S2) in the range of about 0.056 inches to about 0.070 inches, including a most preferred spacing (i.e., a distance S1 and/or a distance S2) of about 0.06 inches, is critical to achieving improved grippability, as well as a tactile feeling or sensation that is desirable to a user. While the embodiments described above provide the distance S1 being substantially equal to the distance S2, these distances S1 and S2 could, alternatively, have different values from each other. For example, according to one embodiment, distance S1 and distance S2 are both between about 0.045 inches to about 0.100 inches, and are, preferably, between about 0.053 inches and about 0.080 inches, and are, most preferably, between about 0.056 inches and about 0.070 inches. Distance S1 and distance S2 can each have, however, different values that fall within one or more of these disclosed ranges.

According to the embodiment of FIG. 3A, a ratio of (i) the spacing between each of the raised elements 24 in the x-direction (i.e., the distance S1) and (ii) the spacing between each of the raised elements 24 in the y-direction (i.e., the distance S2) is about 1:1. According to another embodiment, the ratio between the distance S1 and the distance S2 can be between about 0.45:1 and about 2.2:1, and, preferably, between about 0.5:1 and about 2:1. Alternatively, the ratio between the distance S1 and the distance S2 can be between about 1:0.45 and about 1:2.2, and, preferably, between about 1:0.5 and about 1:2. For example, according to one embodiment, the distance S1 is about 0.045 inches, while the distance S2 is about 0.1 inches. Thus, according to this embodiment, the ratio of the distance S1 to the distance S2 is about 1:2.2, or, alternatively, 0.45:1. According to another embodiment, for example, the distance S1 is about 0.06 inches, while the distance S2 is about 0.045 inches. Thus, according to this embodiment, the ratio of S1 to S2 is about 1:0.75, or, alternatively, 1.33:1.

As also shown in FIG. 3A, each of the raised elements 24 is also spaced a distance S3 from another raised element 24 in a diagonal direction. This distance S3 can be determined based on (i) the spacing between each of the raised elements 24 in the x-direction (i.e., the distance S1) and (ii) the spacing between each of the raised elements 24 in the y-direction (i.e., the distance S2). In particular, the distance S3 can be determined based on the following equation, namely, Pythagorean theorem:

$$S1^2+S2^2=S3^2.$$

For example, according to one embodiment, when the distance S1 is 0.06 inches and the distance S2 is 0.06 inches, the distance S3 will be equal to 0.085 inches. According to another embodiment, when the distance S1 is 0.10 inches and the distance S2 is 0.10 inches, the distance S3 will be equal to 0.14 inches.

While the embodiments described above provide for (i) a spacing between each of the raised elements 24 in the x-direction (i.e., the distance S1) and (ii) a spacing between each of the raised elements 24 in the y-direction (i.e., the distance S2), the spacing between each of the raised elements 24 (i.e., the distance S1 and/or the distance S2) does not have to be in a rectilinear direction, e.g., a straight line direction, that extends either (i) along the length of the bag between the first side edge 15 and the second side edge 17 (i.e., the distance S1), or (ii) along the height of the bag between the bottom edge 19 and the respective top edge 20A and 20B (i.e., the distance S2). Alternatively, the spacing between each of the raised elements 24 (i.e., the distance S1 and/or the distance S2) could extend diagonally, sinusoidally, in a curved manner, in a starburst pattern, etc., and any combination thereof.

As also shown in the embodiment of FIG. 3A, a dashed box 25 is provided to illustrate another feature of the texture 16 that is provided to at least one of the surfaces of the lip 21A' and/or the lip 21B'. In this regard, the dashed box 25 illustrates the number of contact points per square inch of the plurality of raised elements 24 of the texture 16 (e.g., a density of the plurality of raised elements 24 of the texture 16). According to one embodiment, this feature of the number of contact points per square inch is between about 95 and about 500 contact points per square inch, and is, preferably, between about 200 and about 450 contact points per square inch, and is, most preferably, between about 250 and about 375 contact points per square inch. Moreover, the spacing, as discussed above, between each of the raised elements 24 (i.e., the distance S1 and/or the distance S2) is directly related to the number of contact points per square inch (box 25 in FIG. 3A). Accordingly, when the critical range of the spacing between each of the raised elements 24 (i.e., the distance S1 and/or the distance S2) of about 0.056 inches to about 0.070 inches, including a most preferred spacing of about 0.06 inches, is achieved, a critical number of contact points per square inch can also be achieved, i.e., a critical range of between about 250 and about 375 contact points per square inch. This critical range for the number of contact points per square inch results from the feel of the texture 16 to the user that is most favorable or desirable, as discussed above. Thus, when the critical range of between about 250 and about 375 contact points per square inch is achieved with the raised elements 24, improved grippability, as well as a tactile feeling or sensation that is desirable to a user is also achieved.

Figure 3B:
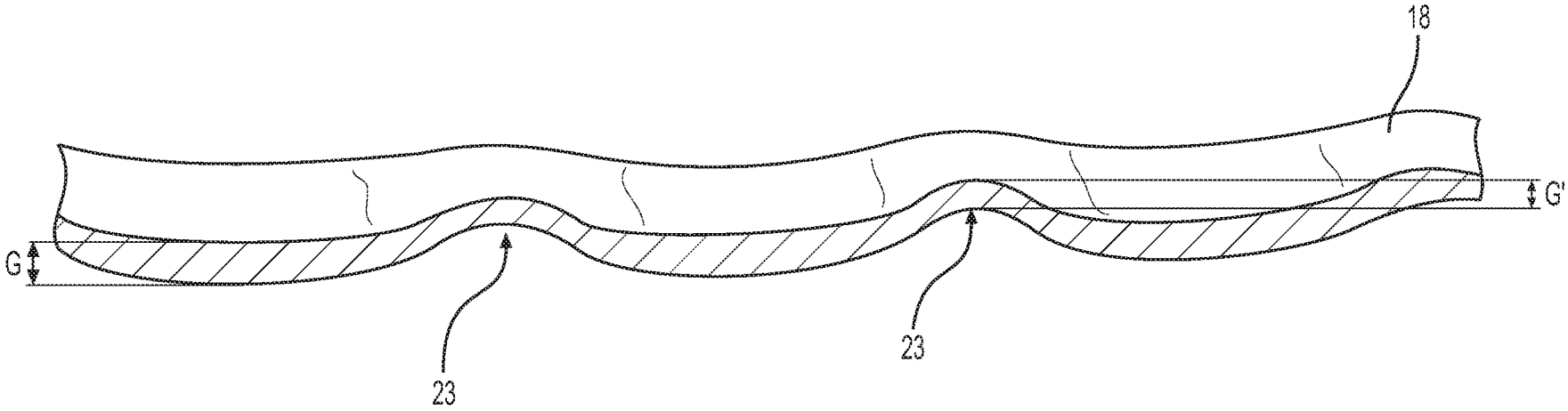
FIG. 3B is a cross-sectional view of the top end of the bag shown in FIG. 3A as taken along line 3B-3B.
Figure 3C:
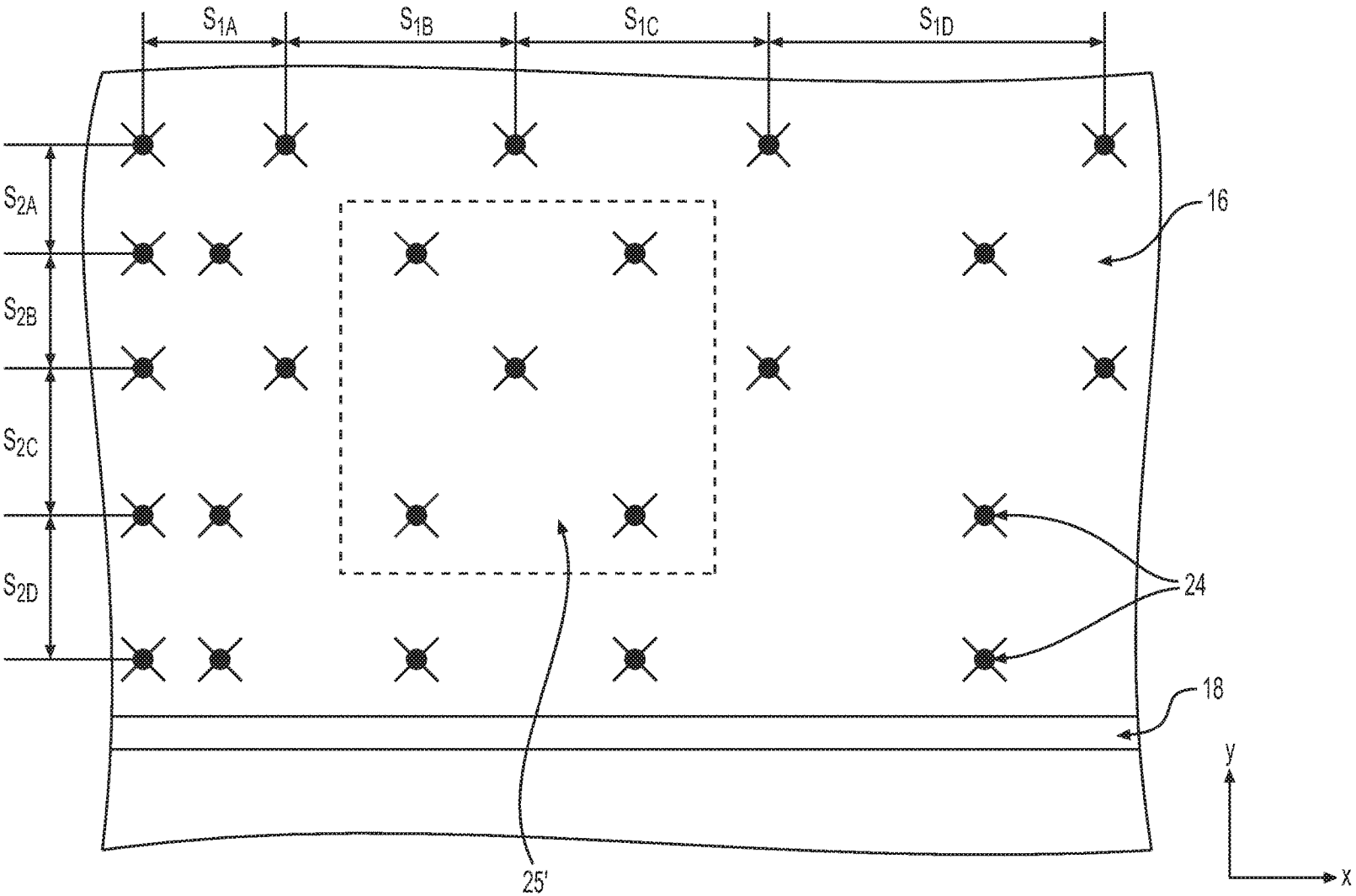
FIG. 3C is a partial view of the top end of the bag shown in FIG. 2A, of the area in circle 3A, according to an alternative embodiment.

While the embodiments described above provide for a spacing between each of the raised elements 24 in the x-direction (i.e., the distance S1) that is the same along the length of the bag between the first side edge 15 and the second side edge 17, as shown in the alternative embodiment of FIG. 3C, the spacing between each of the raised elements 24 in the x-direction can vary along the length of the bag between the first side edge 15 and the second side edge 17 (see, e.g., the distances $S1_A$, $S1_B$, $S1_C$, and $S1_D$). In addition, while the embodiments described above provide for a spacing between each of the raised elements 24 in the y-direction (i.e., the distance S2) that is the same along the height of the bag between the bottom edge 19 and the respective top edge 20A and 20B, as also shown in the embodiment of FIG. 3C, the spacing between each of the raised elements 24 in the y-direction can vary along the height of the bag between the bottom edge 19 and the respective top edge 20A and 20B (see, e.g., the distances $S2_A$, $S2_B$, $S2_C$, and $S2_D$). Additionally, according to the embodiment of FIG. 3C, not only can the spacing between each of the raised elements 24 in the x-direction vary (see, e.g., the distances $S1_A$, $S1_B$, $S1_C$, and $S1_D$), but the spacing between each of the raised elements in the x-direction can vary between the various rows of the pattern 16. Similarly, according to the embodiment of FIG. 3C, not only can the spacing between each of the raised elements 24 in the y-direction vary (see, e.g., the distances $S2_A$, $S2_B$, $S2_C$, and $S2_D$), but the spacing between each of the raised elements in the y-direction can vary between the various columns of the pattern 16. Moreover, while the embodiments described above provide for a number of contact points per square inch of the plurality of raised elements 24 of the texture 16 (e.g., the box 25 in FIG. 3A) that is the same across the length and/or the height of the bag, as further shown in the embodiment of FIG. 3C, the number of contact points per square inch (i.e., the box 25' in FIG. 3C) can vary across the length and/or the height of the bag. Thus, any combination of (i) the spacing between each of the raised elements 24 in the x-direction (i.e., the distance S1), (ii) the spacing between each of the raised elements 24 in the y-direction (i.e., the distance S2), and (iii) the number of contact points per square inch of the plurality of raised elements 24 of the texture 16 (e.g., the box 25 in FIG. 3A and/or the box 25' in FIG. 3C) can be used to achieve the desired grippability and/or tactile feeling or sensation to a user.

As further shown in FIG. 3A, the plurality of raised elements 24 of the texture 16, when provided to at least one surface of the lip 21A' and/or the lip 21B' that includes at least one gripping ridge 18, can cause a plurality of detents 23 to occur to the at least one gripping ridge 18. These detents 23 occur where the raised elements 24 of the texture 16 impact the structure of the at least one gripping ridge 18. For example, according to one embodiment, as shown in FIG. 3B, the at least one gripping ridge 18 has an initial height G. When the raised elements 24 of the texture 16, however, impact the at least one gripping ridge 18 to cause the detents 23 to occur to the at least one gripping ridge 18, each of the detents 23 have a height G' that is less than the initial height G of the at least one gripping ridge 18. Accordingly, the height G of the at least one gripping ridge 18 differs from the height G' of each of the detents 23. For example, according to one embodiment, the at least one gripping ridge 18 has a height G of at least about 0.005 inches, and, preferably, between about 0.005 inches and about 0.010 inches. Thus, the height G' of each of the detents 23 is less than about 0.010 inches, and generally less than about 0.005 inches.

While the embodiments of FIGS. 3A and 3B illustrate the at least one gripping ridge 18 comprising a plurality of detents 23, the texture 16 can be added to the at least one surface of the lip 21A' and/or the lip 21B' without impacting the at least one gripping ridge 18 (see, e.g., FIG. 3C). Thus, the integrity of the at least one gripping ridge 18 can be maintained by not forming the texture 16 onto the at least one gripping ridge 18. That is, the at least one gripping ridge 18 is not substantially disrupted by the plurality of raised elements 24 of the texture 16, and, as such, the at least one gripping ridge 18 extends substantially continuously along the top end of the bag 10'.

Figure 4:
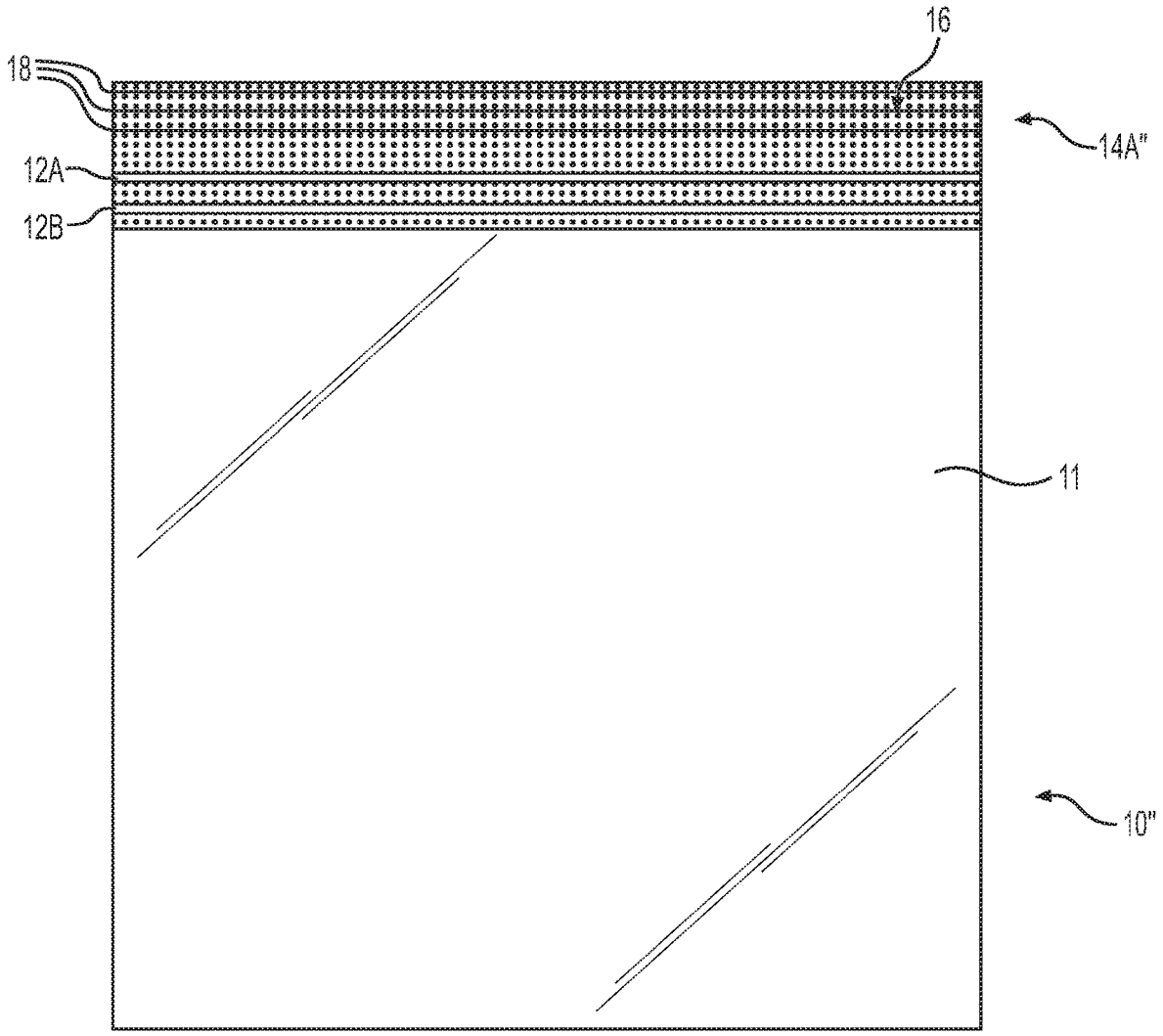
FIG. 4 is a side view of a bag according to another embodiment of the invention.

FIG. 4 shows a bag 10" according to another embodiment of the invention. The bag 10" is configured similar to the bag 10' described above, with the exception of the texture 16 extending beyond the at least two zipper profiles 12A and 12B. While in this embodiment, as shown in FIG. 4, the texture 16 extends to slightly past the at least two zipper profiles 12A and 12B, the texture 16 could (i) extend to an area just above the upper zipper profile 12A, (ii) extend to an area between the at least two zipper profiles 12A and 12B, (iii) extend all the way to the bottom edge 19 of the bag 10", or (iv) comprise any combination thereof. It should be noted that, although the bag 10" described herein includes two zipper profiles 12A and 12B, other embodiments of the bag can include only a single zipper profile, i.e., a single interlocking member extending from the first closure profile of the bag that can connect to an interlocking member extending from the second closure profile of the bag (see, e.g., FIG. 1A). Still other embodiments can include more than two zipper profiles. In each of these embodiments, the texture 16 can (i) extend to an area just above the at least one zipper profile, (ii) extend to an area between at least two zipper profiles, (iii) extend all the way to the bottom edge 19 of the bag, or (iv) comprise any combination thereof.

Figure 5A:
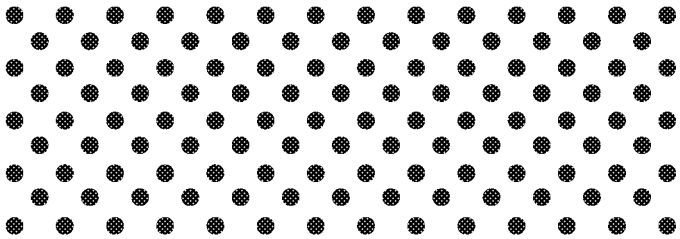
FIGS. 5A to 5J illustrate various patterns of textures to include with a bag according to various embodiments of the invention.
Figure 5B:
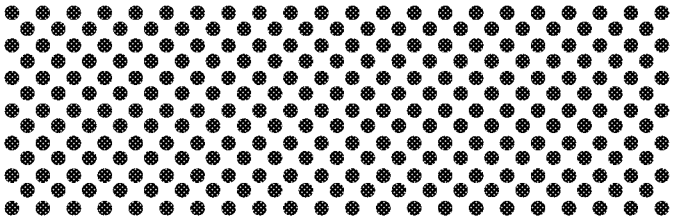
Figure 5C:
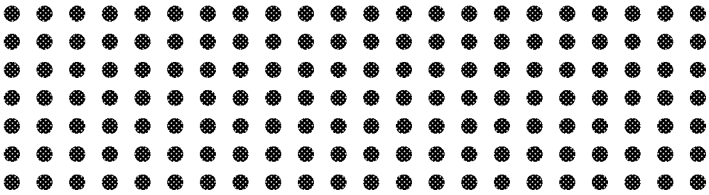
Figure 5D:
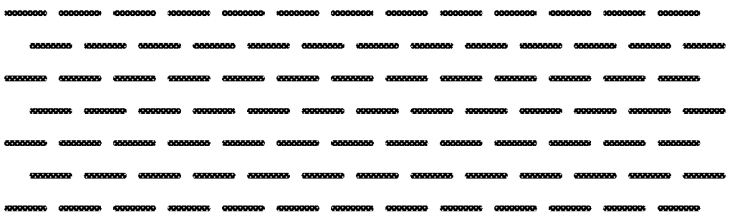
Figure 5E:
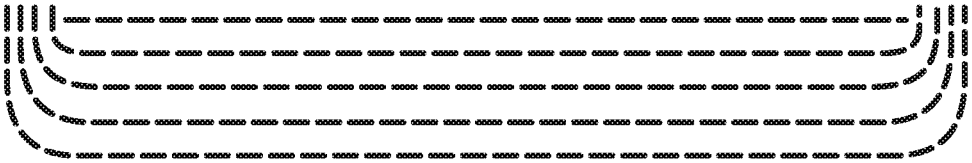
Figure 5F:
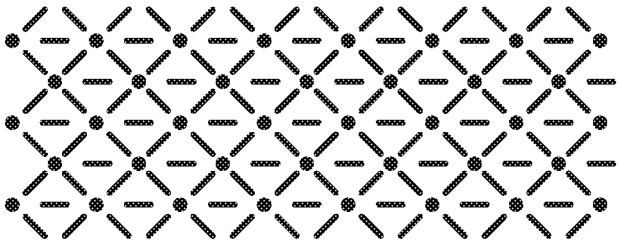
Figure 5G:
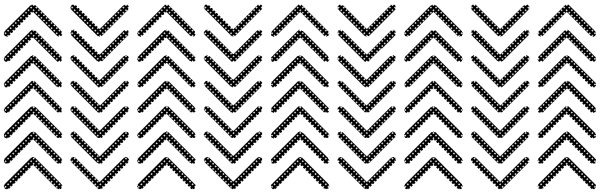
Figure 5H:
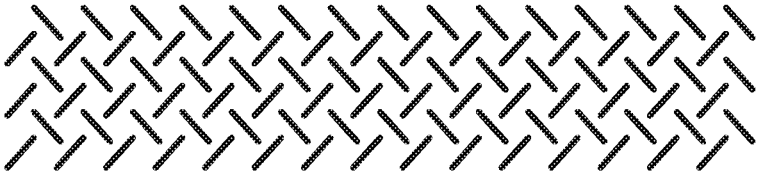
Figure 5I:
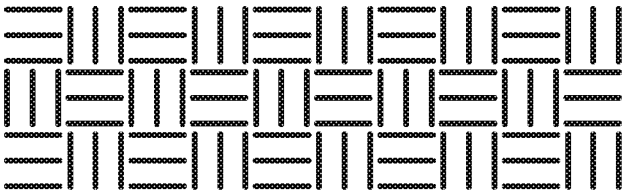
Figure 5J:
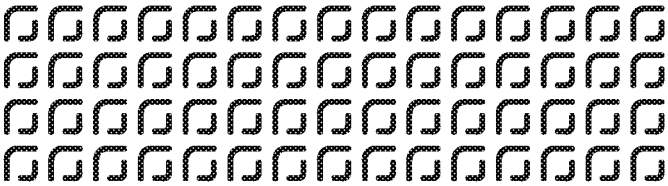

FIGS. 5A to 5J illustrate various patterns for the texture 16 to be added to at least one of the surfaces of at least one of the lips of the bag. FIG. 5A illustrates a coarse staggered dot pattern for the texture 16. FIG. 5B illustrates a fine staggered dot pattern for the texture 16. FIG. 5C illustrates a straight dot pattern for the texture 16. FIG. 5D illustrates a staggered bar pattern for the texture 16. FIG. 5E illustrates a varying bar pattern for the texture 16. FIG. 5F illustrates a pattern for the texture 16 that comprises a plurality of dots and lines. FIG. 5G illustrates a plurality of ridge shapes for the texture 16. FIG. 5H illustrates a varying pattern of lines that resembles a tire tread for the texture 16. FIG. 5I illustrates another varying pattern of lines that resembles a weave pattern for the texture 16. FIG. 5J illustrates a plurality of lines of open squares for the texture 16. While the texture 16 of the embodiments illustrated in FIGS. 1A, 2A, 3A, 4, 6A, 6B, 7, and 9 generally comprises the pattern shown in FIG. 5C, any of the patterns illustrated in FIGS. 5A to 5J can be used, as well as any combination thereof. Moreover, those skilled in the art will also recognize that the texture 16 could be formed with a wide variety of alternative shapes and any combination thereof.

Figure 6A:
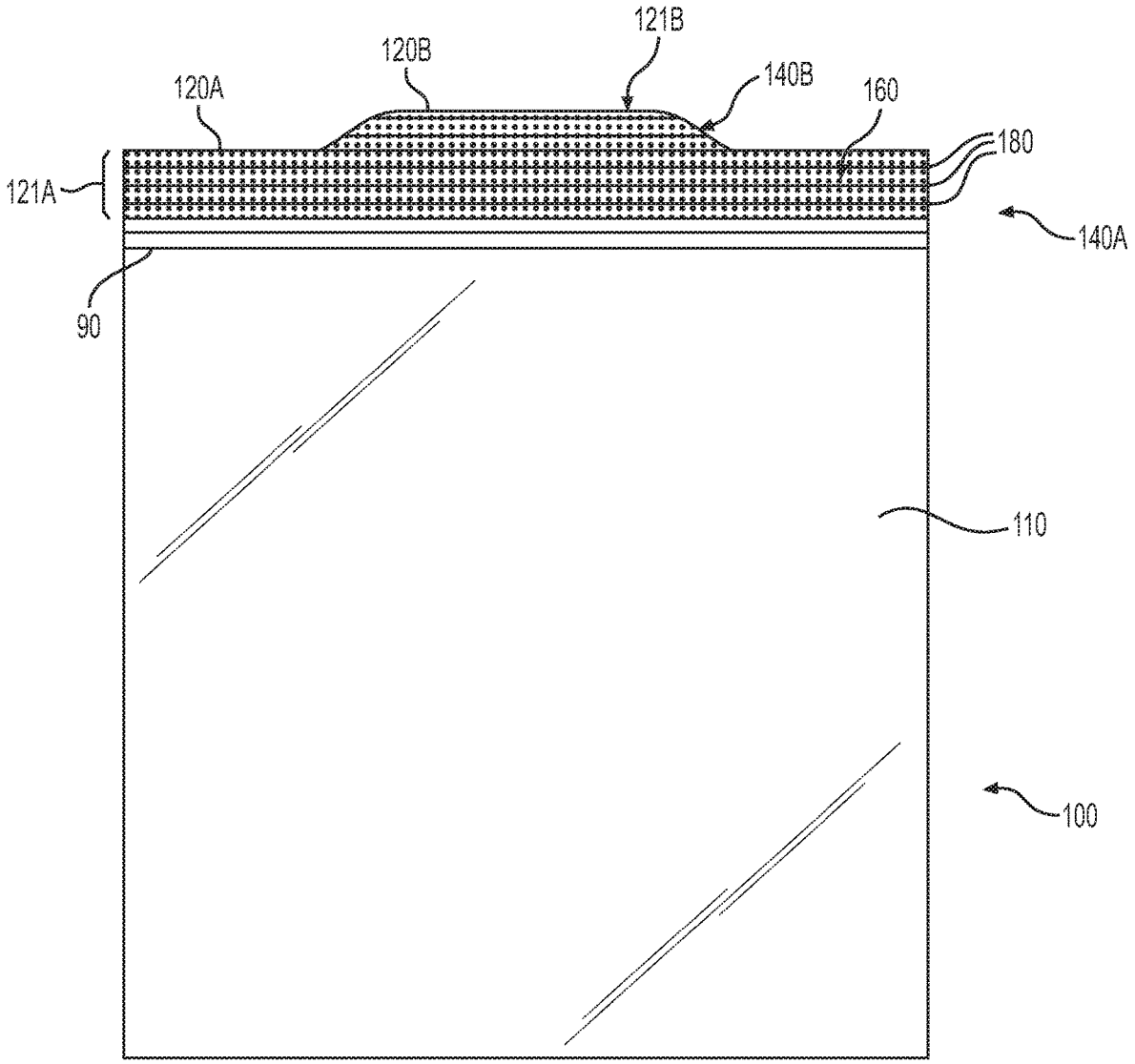
FIG. 6A is a side view of a bag according to another embodiment of the invention.
Figure 6B:
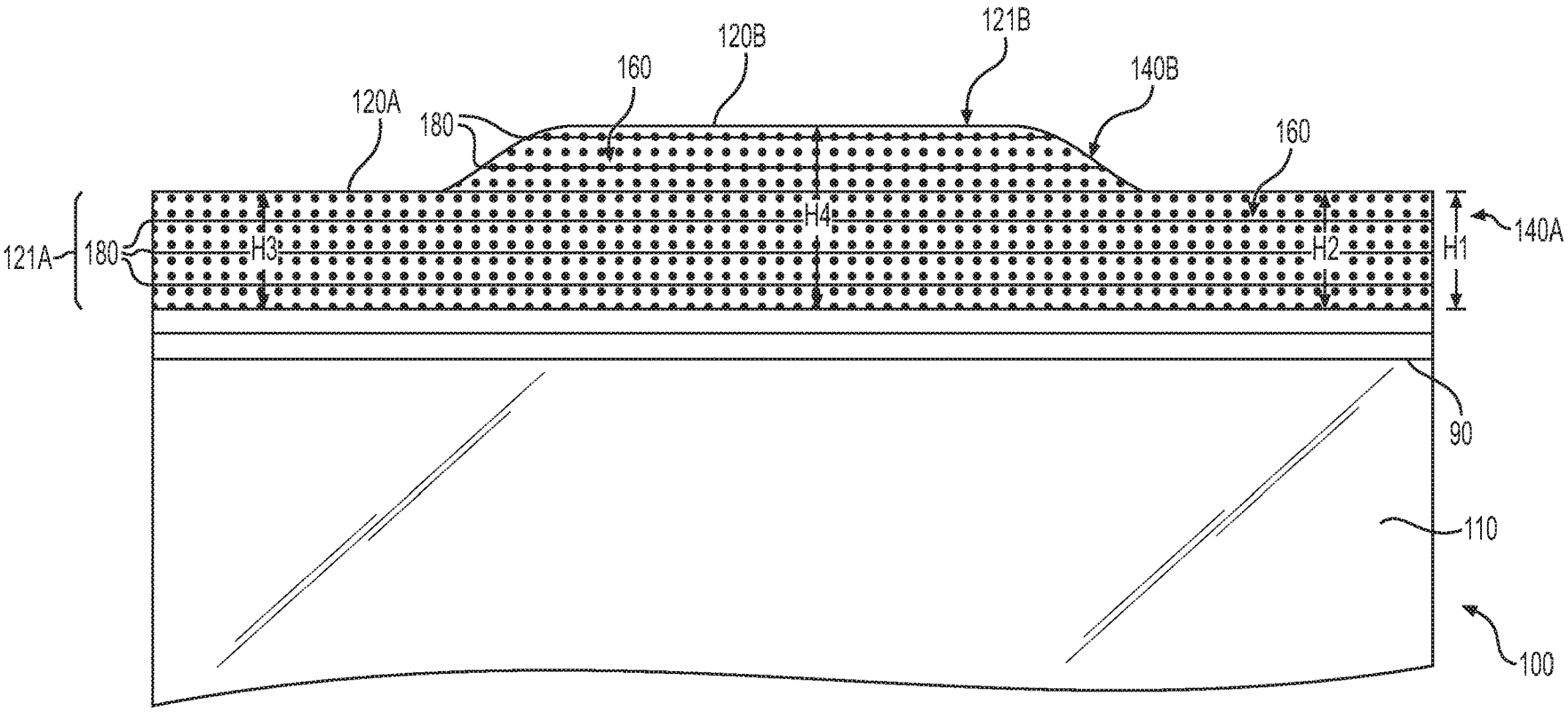
FIG. 6B is a view of the top end of the bag shown in FIG. 6A.

FIGS. 6A and 6B illustrate a bag 100 according to another embodiment of the invention. The bag 100 is configured similar to the bag 10' described above, with the exception of the configuration of the first and second closure profiles 140A and 140B. In bag 100, the first lip 121A extends a substantially constant distance H1 from the zipper profile 90 to the top edge 120A of the first closure profile 140A. On the other hand, the second lip 121B of the second closure profile 140B includes a first portion that extends a distance H2 from the zipper profile 90 to the top edge 120B, a second portion that extends a distance H3 from the zipper profile 90 to the top edge 120B, and a third portion that extends a distance H4 from the zipper profile 90 to the top edge 120B. The second lip 121B also includes portions that vary between the distances H2 to H4, and portions that vary between the distances H3 to H4. It should be noted, however, that, in an alternative embodiment, the portions of the second lip 121B that vary in distance from the zipper profile 90 to the top edge 120B can be omitted. That is, the bag 100 could be provided such that the first portion with the distance H2 transitions directly to the third portion with the distance H4, and the second portion with the distance H3 transitions directly to the third portion with the distance H4. It should also be noted that, although the distances H2 and H3 are shown as being about equal in the embodiment depicted in FIGS. 6A and 6B, in other embodiments, the distances H2 and H3 are different.

The bag 100 is configured such that the distance H1 is about equal to each of the distances H2 and H3, but the distance H1 could, alternatively, be greater than or less than the distances H2 and/or H3. In the embodiment of FIGS. 6A and 6B, the bag is further configured such that the distance H1 is less than the distance H4. Thus, a portion of the lip 121B formed by the second closure profile 140B extends above the edge 120A formed by the first closure profile 140A. The first and second lips 121A and 121B are therefore easily distinguishable, and the user is provided with a visual cue as to where to grasp the lips 121A and 121B in order to unseal the zipper profile 90. Further, the user is led to grasp the lips 121A and 121B at a center region of the bag 100 where the second lip 121B extends above the first lip 121A. By grasping the lips 121A and 121B at the center region, the user can impart a rolling motion to the lips, which facilitates separation of the first and second closure profiles 140A and 140B, and thus, unsealing of the zipper profile 90. Alternatively, the bag 100 can be configured such that the distance H1 is greater than each of the distances H2 and H3. Even in this alternative embodiment, however, a portion of the lip 121B formed by the second closure profile 140B extends above the edge 120A formed by the first closure profile 140A. Thus, the first and second lips 121A and 121B are easily distinguishable, and the user is provided with a visual cue as to where to grasp the lips 121A and 121B in order to unseal the zipper profile 90.

As also shown in the embodiment of FIGS. 6A and 6B, the first and second lips 121A and 121B of the bag 100 include a texture 160. As discussed above, the texture 160 facilitates gripping of the lips 121A and 121B, and hence, opening of the bag 100. Such a texture 160 may easily be formed on one or both of the surfaces of the lips 121A and 121B using a variety of techniques, with one example being embossing. Other techniques include ultrasonic forming, blasting with sand or water jets to abrade the surface, heating patterns, laser ablations, a textured casting roll, and removing portions of the substrate in the lip area. In addition, as discussed above, the texture 160 can be provided to (i) either the interior or exterior surface of one of the lips 121A or 121B, (ii) either the interior or exterior surface of both of the lips 121A and 121B, (iii) both the interior and exterior surface of one of the lips 121A or 121B, (iv) both the interior and exterior surface of both of the lips 121A and 121B, or (v) any combination thereof. Further, the texture 160 can extend in an area directly adjacent to the zipper profile 90 to the respective top edge 120A and 120B, or in an area that is spaced from the zipper profile 90 to the respective top edge 120A and 120B. The texture 160 can also be provided continuously across one or both of the surfaces of the lips 121A and 121B, or in one or more portions of one or both of the surfaces of the lips 121A and 121B.

In addition to the texture 160 that is provided to the surfaces of the first and second lips 121A and 121B, gripping ridges 180 are also provided that further improve the grippability of the lips 121A and 121B. In the embodiment of FIGS. 6A and 6B, gripping ridges 180 are provided to at least one surface of both of the lips 121A and 121B. Moreover, each of the gripping ridges 180 is spaced apart from another gripping ridge 180, with the texture 160 continuing between each of the gripping ridges 180. Although the embodiment of FIGS. 6A and 6B illustrates gripping ridges 180 being provided to the interior surfaces of both of the lips 121A and 121B, the gripping ridges 180 could alternatively be provided to (i) either the interior or exterior surface of one of the lips 121A or 121B, (ii) either the interior or exterior surface of both of the lips 121A and 121B, (iii) both the interior and exterior surface of one of the lips 121A or 121B, (iv) both the interior and exterior surface of both of the lips 121A and 121B, or (v) any combination thereof. In addition, any number of gripping ridges 180 can be added to the inside and/or outside of the lips 121A and 121B. As discussed above, the combination of the texture 160 and the gripping ridges 180 further improves the grippability of the lips 121A and 121B by providing particularly effective gripping surfaces that a user can easily grasp when unsealing the at least one zipper profile 90. The texture 160 and/or gripping ridges 180 can also assist a user when sealing the at least one zipper profile 90, by providing improved grippability at the end(s) of the bag, as well as a tactile feedback to the user as the at least one zipper profile 90 is being sealed. Additionally, the texture 160 and/or the gripping ridges 180 provide a feedback to a consumer, in the form of, for example, a visual and/or tactile cue for locating the lips 121A and 121B of the bag 100.

Figure 7:
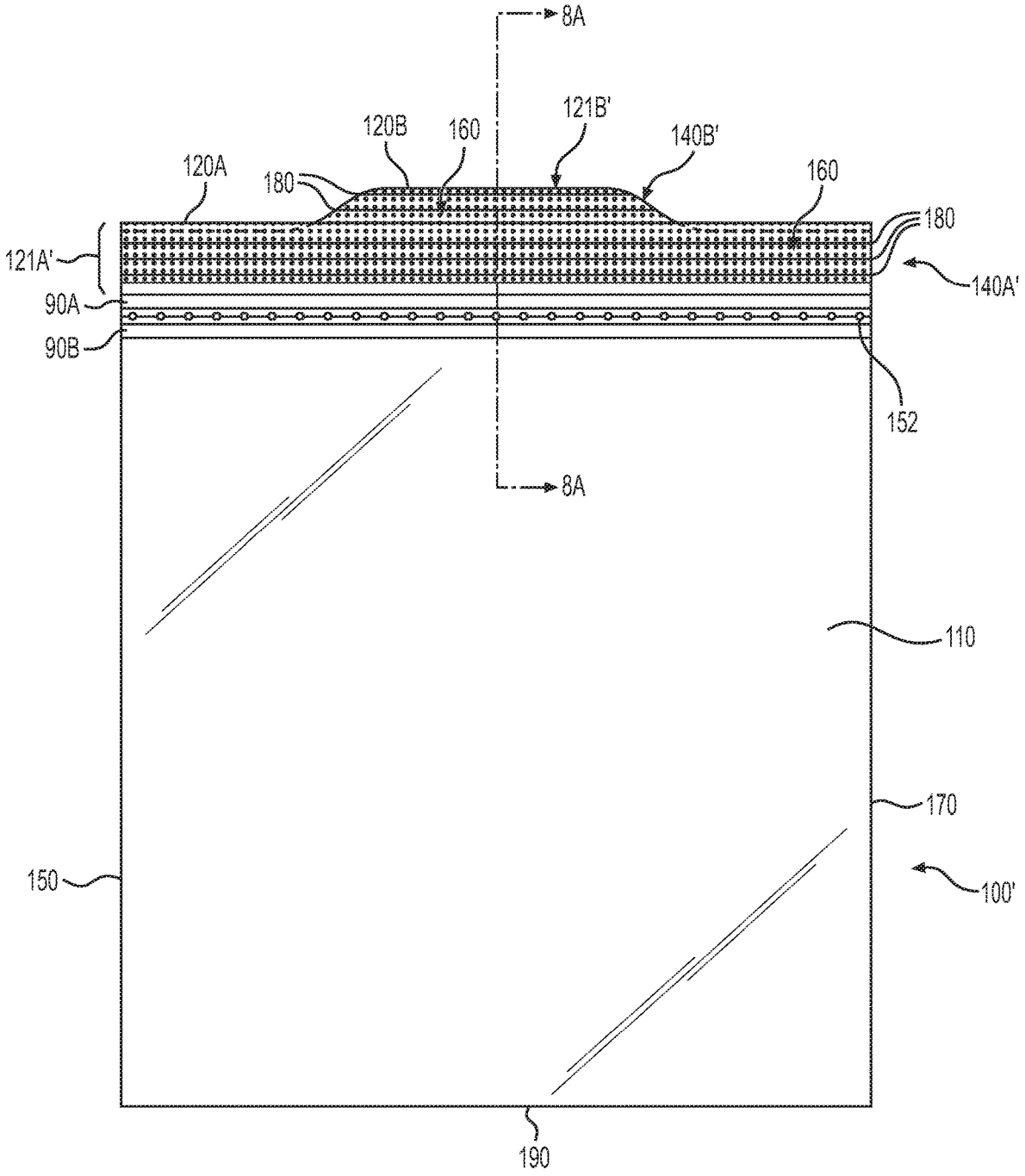
FIG. 7 is a side view of a bag according to another embodiment of the invention.
Figure 8A:
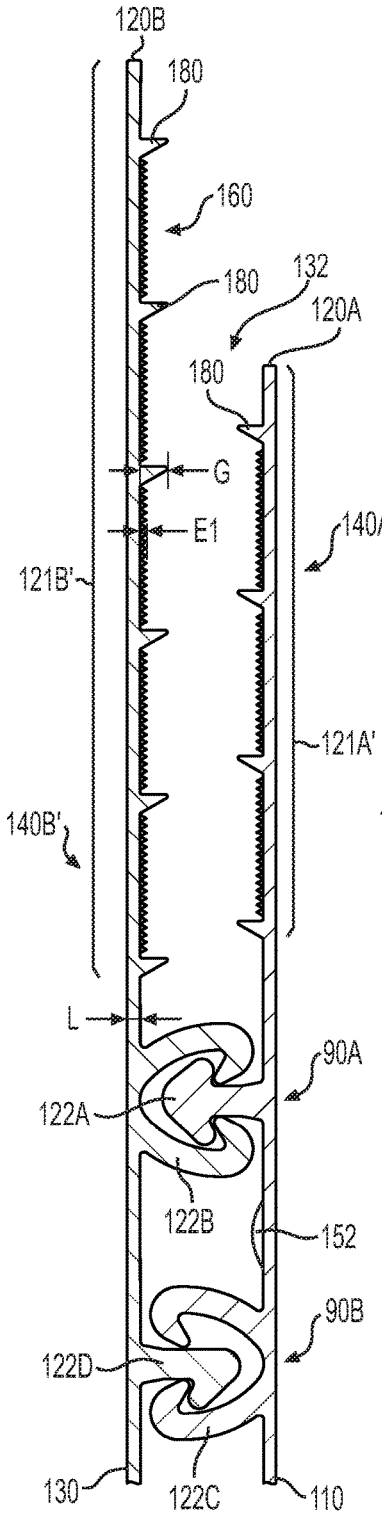
FIG. 8A is cross-sectional view of the top end of the bag shown in FIG. 7 as taken along line 8A-8A.
Figure 8B:
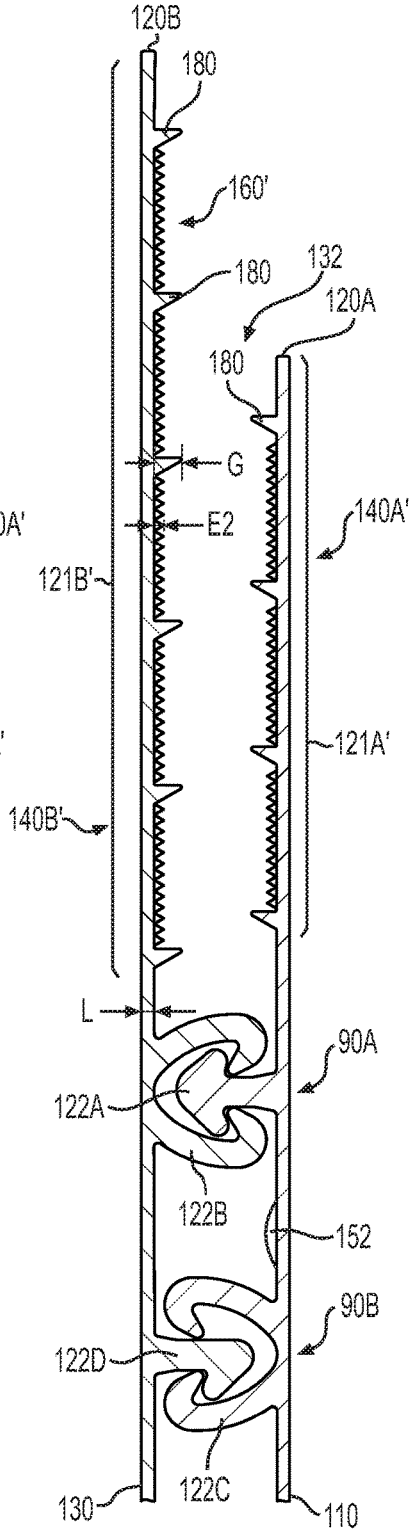
FIGS. 8B and 8C are cross-sectional views of the top end of the bag shown in FIG. 7 as taken along line 8A-8A, according to alternative embodiments.
Figure 8C:
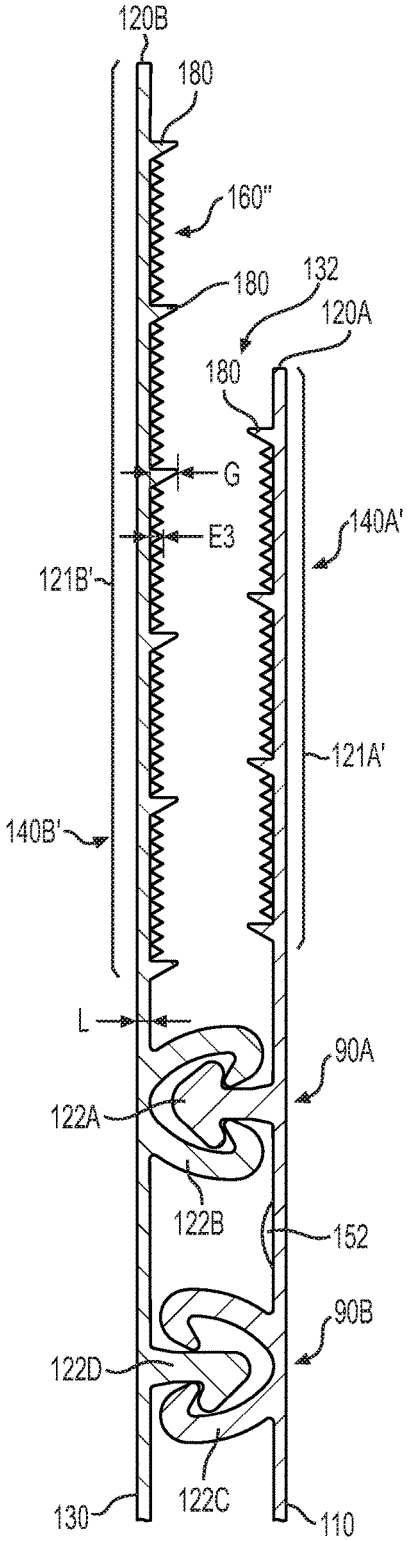

FIGS. 7 and 8A to 8C are views of a bag 100' according to another embodiment of the invention. The bag 100' is configured similar to the bag 100 described above, with the exception of the first and second closure profiles 140A' and 140B' including (i) at least two closure mechanisms or zipper profiles 90A and 90B and (ii) dimples 152 provided between the at least two zipper profiles 90A and 90B, which will be described in detail below. The zipper profiles 90A and 90B, preferably, both extend along each of the first side surface 110 and the second side surface 130, from one of the edges 150 to a second of the edges 170. The zipper profiles 90A and 90B each comprises at least one pair of closure members or interlocking members (see, e.g., elements 122A, 122B, 122C, and 122D of FIGS. 8A to 8C) for sealing the opening 132 of the bag 100'. As shown in FIGS. 8A to 8C, the first interlocking member 122A of the upper zipper profile 90A extends from the first closure profile 140A', and the second interlocking member 122B of the upper zipper profile 90A extends from the second closure profile 140B' at a position opposite to the first interlocking member 122A. As also shown in FIGS. 8A to 8C, a third interlocking member 122C of the lower zipper profile 90B extends from the first closure profile 140A', and a fourth interlocking member 122D of the lower zipper profile 90B extends from the second closure profile 140B' at a position opposite to the third interlocking member 122C. The interlocking members 122A, 122B, 122C, and 122D can be interlocked and unlocked, with the interlocking members 122A and 122D being a male-type profile that is received by the female-type interlocking members 122B and 122C. Such interlocking of the interlocking members 122A, 122B, 122C, and 122D will also be referred to herein as "occluding." As discussed above, interlocking members such as those depicted in FIGS. 8A to 8C are often referred to as zippers, as is known in the art. Examples of different shapes and configurations of such interlocking members and/or closure members that could be used with the storage bag disclosed herein can be seen in U.S. Pat. Nos. 5,070,584; 7,784,160; 7,886,412; 7,946,766; and 8,061,898, and in U.S. Patent Application Publication No. 2009/0324141, the disclosures of which are incorporated by reference herein in their entirety. Alternatively, the closure mechanism for the storage bag could comprise, for example, a pair of closure members that are sealed via a slider. In another embodiment, the closure mechanism could comprise, for example, an adhesive closure, a magnetic closure, a hook and loop fastener (e.g., a VELCRO® Brand type of closure), a micromechanical closure comprising a plurality of small interlocking members, and/or any other means for closing the top end of the storage bag.

It should be noted that, although the bag 100' described herein includes two pairs of interlocking members 122A, 122B, 122C, and 122D, other embodiments of the bag can include only one pair of closure members and/or interlocking members, i.e., a single interlocking member extending from the first closure profile of the bag that can connect to an interlocking member extending from the second closure profile of the bag (see, e.g., FIG. 6A). Still other embodiments can include more than two pairs of closure members and/or interlocking members. As also noted above, the interlocking members 122A, 122B, 122C, and 122D do not necessarily need to fully extend to the edges of the bag 100'. For example, in some embodiments, the bag 100' may include extended sealed sections at the edges 150 and 170 of the bag 100', with the interlocking members 122A, 122B, 122C, and 122D configured to extend only from one sealed section to the other, and not all the way to the edges 150 and 170 of the bag 100'. In this regard, references herein to the interlocking members 122A, 122B, 122C, and 122D "extending between" the sides of the closure profiles 140A' and 140B' do not necessarily indicate that the interlocking members 122A, 122B, 122C, and 122D extend all the way to edges 150 and 170 of the closure profiles 140A' and 140B'.

Similar to the bag 100 described above, the closure profiles 140A' and 140B' of the bag 100' also form lips 121A' and 121B' that extend from the at least two zipper profiles 90A and 90B to the respective top edge 120A and 120B of the bag 100'. In particular, similar to the lips 121A and 121B of the bag 100 illustrated in FIGS. 6A and 6B, the lips 121A' and 121B' of the bag 100' extend the various heights H1-H4, as described above with regard to FIG. 6B. In addition, as shown in FIGS. 7 and 8A to 8C, one or both of the surfaces of the lips 121A' and 121B' includes a texture 160, 160', and 160". As discussed above, the texture 160, 160', and 160" facilitates gripping of the lips 121A' and 121B', and hence, opening of the bag 100'. Such a texture 160, 160', and 160" may easily be formed on one or both of the surfaces of the lips 121A' and 121B' using a variety of techniques, with one example being embossing. Other techniques include ultrasonic forming, blasting with sand or water jets to abrade the surface, heating patterns, laser ablations, a textured casting roll, and removing portions of the substrate in the lip area. In addition, the texture 160, 160', and 160" can be provided to (i) either the interior or exterior surface of one of the lips 121A' or 121B', (ii) either the interior or exterior surface of both of the lips 121A' and 121B', (iii) both the interior and exterior surface of one of the lips 121A' or 121B', (iv) both the interior and exterior surface of both of the lips 121A' and 121B', or (v) any combination thereof. Further, the texture 160, 160', and 160" can extend in an area directly adjacent to the zipper profile(s) 90A and 90B to the respective top edge 120A and 120B, or in an area that is spaced from the zipper profile(s) 90A and 90B to the respective top edge 120A and 120B. The texture 160, 160', and 160" can also be provided continuously across one or both of the surfaces of the lips 121A' and 121B', or in one or more portions of one or both of the surfaces of the lips 121A' and 121B'.

In addition to the texture 160, 160', and 160" that is provided to at least one of the surfaces of at least one of the lips 121A' and 121B', gripping ridges 180 are also provided that further improve the grippability of the lips 121A' and 121B' (see, e.g., FIGS. 8A to 8C). In the embodiment of FIGS. 8A to 8C, gripping ridges 180 are provided to the interior surface of both of the lips 121A' and 121B'. In particular, as shown in FIGS. 8A to 8C, each of the gripping ridges 180 is spaced apart from another gripping ridge 180, with the texture 160, 160', and 160" continuing between each of the gripping ridges 180. Although the embodiment of FIGS. 8A to 8C illustrates gripping ridges 180 being provided to the interior surfaces of both of the lips 121A' and 121B', the gripping ridges 180 could alternatively be provided to (i) either the interior or exterior surface of one of the lips 121A' or 121B', (ii) either the interior or exterior surface of both of the lips 121A' and 121B', (iii) both the interior and exterior surface of one of the lips 121A' or 121B', (iv) both the interior and exterior surface of both of the lips 121A' and 121B', or (v) any combination thereof. In addition, any number of gripping ridges 180 can be added to the inside and/or outside of the lips 121A' and 121B'. As discussed above, the combination of the texture 160, 160', and 160" and the gripping ridges 180 further improves the grippability of the lips 121A' and 121B' by providing particularly effective gripping surfaces that a user can easily grasp when unsealing the interlocking members 122A, 122B, 122C, and 122D. The texture 160, 160', and 160" and/or gripping ridges 180 can also assist a user when sealing the interlocking members 122A, 122B, 122C, and 122D, by providing improved grippability at the end(s) of the bag, as well as a tactile feedback to the user as the interlocking members 122A, 122B, 122C, and 122D are being sealed. Additionally, the texture 160, 160', and 160" and/or gripping ridges 180 provide a feedback to a consumer, in the form of, for example, a visual and/or tactile cue for locating the lips 121A' and 121B' of the bag 100'.

As also shown in the embodiments of FIGS. 8A to 8C, the texture 160, 160', and 160" that is provided to the surfaces of the lips 121A' and 121B' extends a distance (i.e., a height E1, a height E2, or a height E3) from the surface of the respective lip 121A' and 121B', while the gripping ridges each extends a distance G from the surface of the respective lip 121A' and 121B', with the distance G remaining consistent between each of these embodiments. Moreover, as also shown in FIGS. 8A to 8C, the lips 121A' and 121B' each have a thickness L that remains consistent between each of these embodiments.

According to the embodiment of FIG. 8A, each of the raised elements of the pattern 160 (see, e.g., FIG. 3A) extends a distance (i.e., a height E1) that is about 3 mils (or 0.003 inches). According to the embodiment of FIG. 8B, each of the raised elements of the pattern 160' (see, e.g., FIG. 3A) extends a distance (i.e., a height E2) that is about 4.5 mils (or 0.0045 inches). According to the embodiment of FIG. 8C, each of the raised elements of the pattern 160" (see, e.g., FIG. 3A) extends a distance (i.e., a height E3) that is about 6 mils (or 0.006 inches). According to one preferred embodiment, the height E1, the height E2, and/or the height E3 can be between about 2 mils (0.002 inches) and about 8 mils (0.008 inches). According to a more preferred embodiment, the height E1, the height E2, and/or the height E3 can be between about 3 mils (0.003 inches) and about 6 mils (0.006 inches). According to the most preferred embodiment, the height E1, the height E2, and/or the height E3 can be between about 4 mils (0.004 inches) and about 5 mils (0.005 inches). In particular, the inventors have found that a height (i.e., the height E1, the height E2, and/or the height E3) of each of the raised elements of the texture 160, 160' and/or 160" in the range of about 4 mils (0.004 inches) to about 5 mils (0.005 inches), including a most preferred height of about 4.5 mils (0.0045 inches), is critical to the feel of the texture 160, 160' and/or 160" to the user. In this regard, the lower the height of the texture 160, 160' and/or 160", i.e., a height E1, a height E2, and/or a height E3 of less than about 2 mils (0.002 inches), the less feeling the user will have, which, thus, reduces the effect and noticeability of the texture 160, 160' and/or 160". The greater the height of the texture 160, 160' and/or 160", however, i.e., a height E1, a height E2, and/or a height E3 of greater than about 8 mils (0.008 inches), the more the consumer will feel, but too high of a height will cause the user to feel a needle-like sensation that is undesirable. Accordingly, a height (i.e., a height E1, a height E2, and/or a height E3) of each of the raised elements of the texture 160, 160' and/or 160" in the range of about 4 mils (0.004 inches) to about 5 mils (0.005 inches), including a most preferred height of about 4.5 mils (0.0045 inches), is critical to achieving improved grippability, as well as a tactile feeling or sensation that is desirable to a user.

As discussed above, in the embodiments of FIGS. 8A to 8C, the height G of each of the gripping ridges 180 from the surface of the respective lip 121A' and 121B' remains consistent between each of these embodiments. According to one embodiment, each of the gripping ridges have a height G of between about 0.005 inches and about 0.010 inches. Thus, according to one embodiment, a ratio between (i) the height E1, the height E2, and/or the height E3 of each of the raised elements of the texture 160, 160' and/or 160" (see, e.g., FIG. 3A) and (ii) the height G of each of the gripping ridges is generally between about 40 percent and about 80 percent, with a preferred ratio of between about 50 percent and about 70 percent, and a most preferred ratio of between about 55 percent and about 65 percent. In other words, the height E1, the height E2, and/or the height E3 of each of the raised elements of the texture 160, 160' and/or 160" is generally about 40 percent to about 80 percent of the height G of each of the gripping ridges 180, or, preferably, the height E1, the height E2, and/or the height E3 of each of the raised elements of the texture 160, 160' and/or 160" is about 50 percent to about 70 percent of the height G of each of the gripping ridges 180, or, most preferably, the height E1, the height E2, and/or the height E3 of each of the raised elements of the texture 160, 160' and/or 160" is about 55 percent to about 65 percent of the height G of each of the gripping ridges 180.

As also discussed above, in the embodiments of FIGS. 8A to 8C, each of the lips 121A' and 121B' has a thickness L that remains consistent between each of these embodiments. Each of the lips 121A' and 121B', however, has to have a certain thickness L to allow for the height E1, the height E2, and/or the height E3 of each of the raised elements to be achieved. Thus, according to one embodiment, each of the lips 121A' and 121B' has a thickness L of between about 1 mils (0.001 inches) and about 10 mils (0.010 inches). According to a more preferred embodiment, each of the lips 121A' and 121B' has a thickness L of between about 2 mils (0.002 inches) and about 8 mils (0.008 inches). According to a most preferred embodiment, each of the lips 121A' and 121B' has a thickness L of between about 3 mils (0.003 inches) and about 6 mils (0.006 inches).

Moreover, according to another embodiment, a ratio between (i) the height E1, the height E2, and/or the height E3 of each of the raised elements of the texture 160, 160' and/or 160" (see, e.g., FIG. 3A) and (ii) the thickness L of each of the lips 121A' and 121B' is generally between about 50 percent and about 120 percent, with a preferred ratio of between about 68 percent and about 103 percent, and a most preferred ratio of between about 76 percent and about 94 percent. In other words, the height E1, the height E2, and/or the height E3 of each of the raised elements of the texture 160, 160' and/or 160" is generally about 50 percent to about 120 percent of the thickness L of each of the lips 121A' and 121B', or, preferably, the height E1, the height E2, and/or the height E3 of each of the raised elements of the texture 160, 160' and/or 160" is about 68 percent to about 103 percent of the thickness L of each of the lips 121A' and 121B', or, most preferably, the height E1, the height E2, and/or the height E3 of each of the raised elements of the texture 160, 160' and/or 160" is about 76 percent to about 94 percent of the thickness L of each of the lips 121A' and 121B'. It is also noted that this ratio between (i) the height E1, the height E2, and/or the height E3 of each of the raised elements of the texture 160, 160' and/or 160" (see, e.g., FIG. 3A) and (ii) the thickness L of each of the lips 121A' and 121B' plays an important role in the process of adding the texture 160, 160' and/or 160" to the lips 121A' and/or 121B', because the thickness L of each of the lips 121A' and 121B' has a direct impact on the ability to gain a proper height E1, E2, and/or E3 of each of the raised elements of the texture 160, 160' and/or 160", as discussed above.

According to yet another embodiment, a ratio can be defined between (i) the spacing between each of the raised elements 24 in the x-direction (i.e., the distance S1 shown in FIG. 3A) or (ii) the spacing between each of the raised elements 24 in the y-direction (i.e., the distance S2 shown in FIG. 3A), and (iii) the height E1, the height E2, or the height E3 of each of the raised elements 24 of the texture 160, 160' or 160". This ratio (e.g., S1:E1 or S2:E1) is generally between about 1:0.02 and about 1:0.18. This ratio (e.g., S1:E1 or S2:E1), is, preferably, between about 1:0.04 and about 1:0.113, and is, most preferably, between about 1:0.06 and about 1:0.09, including a most preferred ratio (e.g., S1:E1 or S2:E1) of about 1:0.075.

As also shown in FIGS. 7 and 8A to 8C, at least the first closure profile 140A' includes a plurality of dimples 152 in the area between the upper zipper profile 90A and the lower zipper profile 90B. As shown in FIGS. 8A to 8C, the dimples 152 on the first closure profile 140A' are formed as convex surfaces on the side of the first closure profile 140A' that faces the interior of the bag 100'. Alternatively, the dimples 152 on the first closure profile 140A' can be formed as concave surfaces on the surface of the first closure profile 140A' that faces the interior of the bag 100'. One or both of the closure profiles 140A' and 140B' can include a plurality of dimple features 152. In one embodiment, the dimples 152 advantageously provide a visual cue and/or a tactile feedback that indicate to the user where to place his or her fingers when sealing the interlocking members of the zipper profiles 90A and 90B. The user, therefore, is more assured that the bag 100' is being sealed.

As will be appreciated by those skilled in the art, the dimples 152 can be formed in at least one of the closure profiles 140A' and 140B' using a variety of techniques. As one example, the dimples 152 could be formed using a mechanical operation, such as a pressing operation with a die. In such a pressing operation, heat could also be applied to at least one of the closure profiles 140A' and 140B' in order to facilitate the deformation in the closure profile 140A' and/or 140B' that forms the dimples 152. Alternatively, the dimples 152 could be formed using an ultrasonic forming operation. As still other alternatives, the dimples 152 could be formed by a micromolding process, or as part of a vacuum extrusion operation in the process of forming the closure profiles 140A' and 140B'. With all of these techniques, the dimples 152 are formed in a manner to prevent rupturing or weakening of the closure profiles 140A' and/or 140B'.

In the bag 100' depicted in FIGS. 7 and 8A to 8C, the dimples 152 are formed with substantially spherical sections that have substantially circular cross sections. In particular embodiments, the dimples 152 have a diameter of about 0.125 in. (0.3175 cm). The substantially spherical dimples 152 are uniformly provided throughout the length of at least the first closure profile 140A'. While the dimples 152 are substantially spherical sections with substantially circular cross sections, and while the dimples 152 in FIG. 7 are evenly spaced along the first closure profile 140A', there are numerous alternative shapes and configurations for the dimples 152. For example, the dimples 152 could be provided at irregular points along the closure profiles 140A' and/or 140B'. Those skilled in the art will also recognize that the dimples 152 could be formed with a wide variety of alternative shapes, such as, for example, dimples having a cross section with the shape of rectangles, ovals, triangles, X-shapes, S-shapes, stars, hearts, arrows, Christmas trees, etc.

In the embodiments depicted in FIGS. 7 and 8A to 8C, the dimples 152 are provided between the interlocking members of the upper zipper profile 90A and the lower zipper profile 90B. In other embodiments, however, the dimples 152 can be provided in different positions, such as above the zipper profiles 90A and 90B, or below the zipper profiles 90A and 90B. Moreover, the dimples 152 could be provided in two different areas of the closure profiles 140A' and/or 140B', such as both above zipper profiles 90A and 90B and below the zipper profiles 90A and 90B. Along these lines, as discussed above, embodiments of the bag 100' may only include a single zipper profile. In such embodiments, the dimples 152 may be placed above or below the zipper profile.

Figure 9:
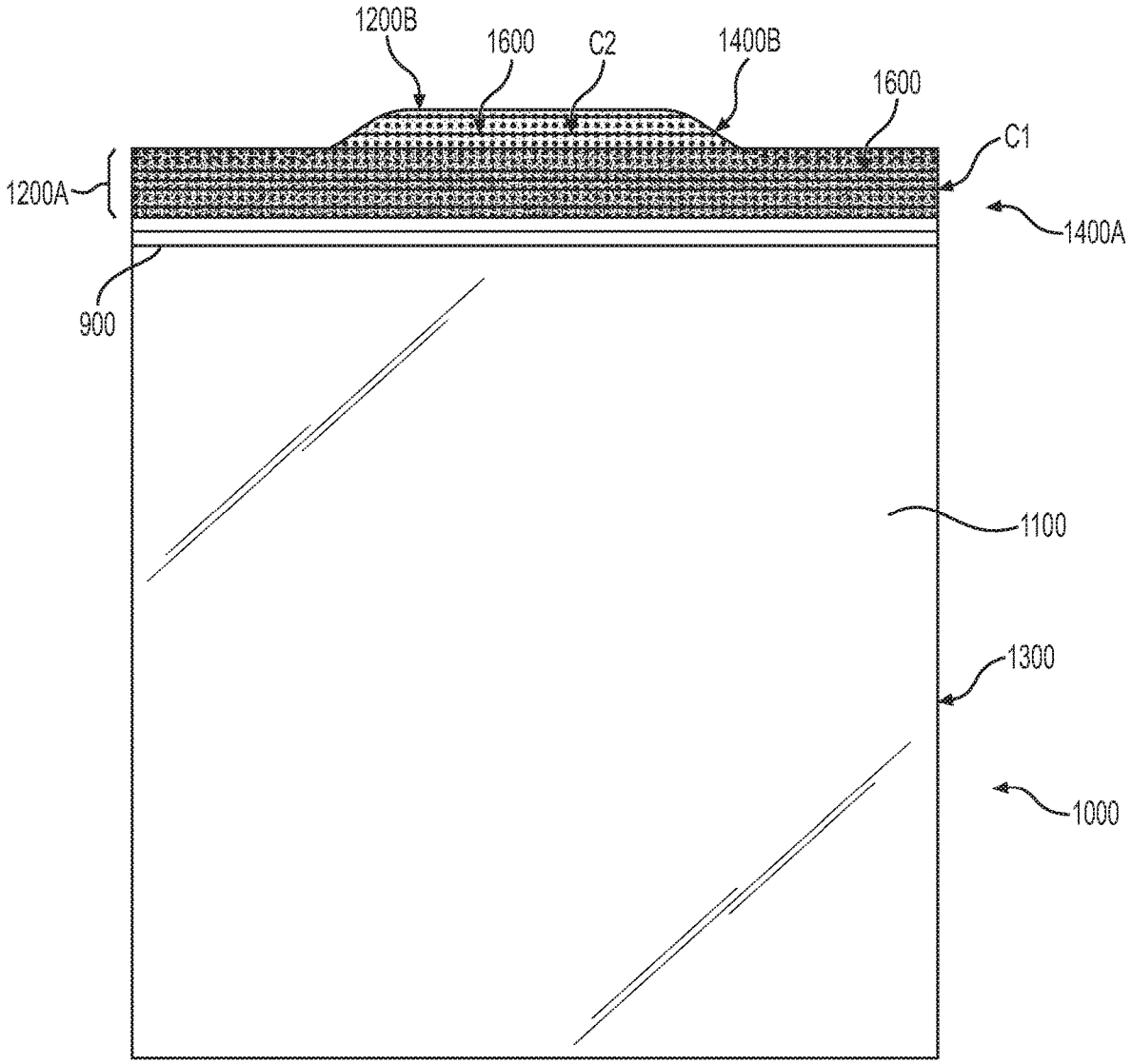
FIG. 9 is a side view of a bag according to another embodiment of the invention.

FIG. 9 shows a bag 1000 according to another embodiment of the invention. The bag 1000 is configured similar to the bag 100 described above, with the exception of the lips 1200A and 1200B of the first and second closure profiles 1400A and 1400B being provided with a color C1 and/or a color C2, in order to provide an aid for distinguishing between the first and second lips 1200A and 1200B. In effect, when the bag 1000 is viewed looking at the first side surface 1100 or the second side surface 1300, the area where the first lip 1200A overlaps the second lip 1200B appears as a noticeably darker color, or as a noticeably darker shade of color, than the area of the second lip 1200B that is not overlapped by the first lip 1200A. Thus, the user can easily distinguish the first and second lips 1200A and 1200B, and it is easier for the user to determine where to grasp the bag 1000 when unsealing the interlocking members of the zipper profile 900.

Additionally, we have found that by providing a color C1 and/or a color C2 to the first and/or second lips 1200A and 1200B, a visual appearance of the raised elements of the texture 1600 is enhanced. In this regard, the inventors have found that when a texture (e.g., texture 1600) is provided to a clear or transparent lip, the raised elements of the texture (e.g., texture 1600) are not necessarily noticeable by a user. By contrast, when a color C1 and/or a color C2 is provided to the lips 1200A and 1200B, the raised elements of the texture 1600 become apparent and/or more visible, which, thus, allows for the texture 1600 to provide a feedback to a consumer, in the form of, for example, a visual cue for locating the lips 1200A and 1200B of the bag 1000.

As will be apparent from the discussion herein, the references to a "darker color" and "a darker shade of color" have different meanings. A CIELAB color space (i.e., a color space defined by the International Commission on Illumination (CIE)) is a common technique for quantifying colors and shades of a color. In this color space, the L* represents the lightness or darkness of a color, and a* and b* represent color-opponent dimensions, based on nonlinearly compressed CIE XYZ color space coordinates. The L*, a*, and b* values for a color of a particular sample can easily be determined by using, for example, a spectrophotometer. As used herein, when considering two color samples, a darker color sample would be one in which the a* and b* values are indicative of the darker color than the other sample, e.g., a* and b* values indicative of a blue color that is darker than the a* and b* values indicative of a yellow color. A darker shade of color, on the other hand, would be indicative of two samples having substantially the same a* and b* values, but different L* values, with the sample having the higher L* value being the lighter shade of color. In this regard, it should be noted that the term "color," as used herein, encompasses black, white, and shades of gray. It should also be noted that a substantially transparent plastic storage bag, as discussed above and as is known in the art, can be considered to have a certain "color." When referencing first and a second colors, or shades of color, herein, one of the first and second colors or shades of color may be the same as the rest of the bag, including substantially transparent portions of the bag.

It follows that the visual effects of the first and second lips 1200A and 1200B described herein can be achieved using different colors, wherein the a* and/or b* values of the lips 1200A and 1200B are different. Qualitatively, the first lip 1200A might appear as a green color, while the second lip 1200B appears as a red color. In such an embodiment, the L* values of the two lips 1200A and 1200B could be the same, or the L* values could be different. In other embodiments, the first and second lips 1200A and 1200B are provided as substantially the same color, i.e., have about the same a* and b* values, but have different L* values. In such a case, the first and second lips 1200A and 1200B are a different shade of color. In still other embodiments, the first and second lips 1200A and 1200B are formed in the same color and the same shade of color. Yet, due to the overlapping of the first lip 1200A with a portion of the second lip 1200B, the overlapping area naturally appears as a darker shade of color than the portion of the second lip 1200B that is not overlapped by the first lip 1200A, when the bag is viewed from the first side surface 1100 or the second side surface 1300. Such an effect can be achieved, for example, by using a larger thickness of the lips 1200A and 1200B. In still other embodiments, the first and second lips 1200A and 1200B can be formed by different colors, which will thereby provide a different color in the overlapping portions of the lips 1200A and 1200B than in the non-overlapped portion of the second lip 1200B, e.g., the first lip 1200A is a yellow color and the second lip 1200B is a blue color such that a green color is produced in the area where the first lip 1200A overlaps the second lip 1200B, when the bag is viewed towards the first side 1100 and/or the second side 1300.

In specific embodiments, the L* values of the two lips 1200A and 1200B are different by a value of about thirty. As examples, the L* value of the darker first lip 1200A is about fifty to about seventy, more specifically, the L* value is about fifty-five to about sixty-five, and even more specifically, the L* value is about fifty-five to about sixty. The L* value of the lighter second lip 1200B is about sixty to about eighty, more specifically, the L* value is about sixty-five to about seventy-five, and even more specifically, the L* value is about seventy to seventy-five. With all of these configurations, the first lip 1200A appears substantially darker than the second lip 1200B. Therefore, a user can easily distinguish between the two lips 1200A and 1200B, which, in turn, makes it easier for the user to determine where to grasp the bag 1000 when unsealing the interlocking members of the zipper profile 900.

The color can be formed in the lips 1200A and 1200B using a variety of techniques. As one example, a colorant in liquid or solid form can be mixed with the resin prior to an extrusion operation that forms the closure profiles 1400A and 1400B of the bag. As a similar example, the color can be introduced by adding color resin pellets or liquid color to a pellet stream where it will be homogenized throughout the plastic during the extrusion process that forms the film and/or the profiles 1400A and 1400B of the bag. In such an arrangement, the coloring agent can be introduced through a separate extruder added to the overall extrusion forming process, for example, by extruding a color layer on the already formed closure profiles 1400A and 1400B. As another example, the color can be applied by painting or printing on the closure profiles 1400A and 1400B. Those skilled in the art will recognize that a wide variety of other techniques could be used to form the colors or shades of color in the lips 1400A and 1400B of the bag 1000.

While the bag 1000 depicted in FIG. 9 is formed with the shorter first lip 1200A being a darker color or a darker shade of color than the longer second lip 1200B, the relative coloring might be reversed, in other embodiments. That is, the shorter first lip 1200A can be a lighter color or a lighter shade of color than the longer lip 1200B. The color contrast in such embodiments can be further emphasized by only providing the darker color or darker shade of color in the portion of the second lip 1200B that is not overlapped by the first lip 1200A. Additionally, while the entire distances between the zipper profile 900 and the edges are provided with color in the embodiment depicted in FIG. 9, in other embodiments, the color need not extend the entire distance(s). Instead, the color may extend over a portion of the lips 1200A and 1200B.

In other embodiments, the color is not a solid block on the lips 1200A and 1200B. Instead, the color may be formed, for example, in patterns or shapes, with the patterns and shapes being continuous or discontinuous. Examples of such patterns and shapes include hearts, flowers, trees, etc. Along these lines, the coloring of either the lip 1200A or the lip 1200B can include multiple colors. Still further, as indicated above, one of the colors or shades of colors of the first and second lips 1200A and 1200B can be the same as the other portions of the bag. Thus, in an embodiment, the color of the first lip 1200A is the same as the color of the substantially transparent side surface 1100, while the lip 1200B is formed with two different colors. Those skilled in the art will appreciate the wide range of coloring options for the lips 1200A and 1200B of the bag 1000.

The interlocking members of the zipper profile 900 may also be colored, and as such, provided as the same color or different colors than the lips 1200A and 1200B. With coloring, the interlocking members of the zipper profile 900 can easily be discerned, thus making it easier for the user to seal and to unseal the bag. Therefore, by providing bag 1000 with colored lips 1200A and 1200B, as well as colored interlocking members of the zipper profile 900, the user can easily identify the portions that are used to seal and to unseal the bag 1000.

The coloring of the lips 1200A and 1200B in bag 1000 may also allow for the bag 1000 to be easily distinguished from other storage bags. That is, the coloring of the lips 1200A and 1200B provides a visual indication to a user of the particular bag, and such a feature may provide an express or an implicit indication of the contents of the bag. For example, blue colored lips might be used to indicate a freezer bag, magenta colored lips might be used to indicate a general storage bag, and green colored lips might be used to indicate a sandwich/snack bag. Moreover, the colored lips 1200A and 1200B might allow a particular bag to stand out amongst other bags, such as a magenta bag amongst green bags. Of course, as the coloring may only be formed in the lips 1200A and 1200B, the first and second side surfaces 1100 and 1300 of the bag 1000 may still be made transparent or substantially transparent. Thus, while the bag 1000 is imparted with an indicative color by the lips 1200A and 1200B, the contents of the bag 1000 can nevertheless still be easily seen.

Figure 10:
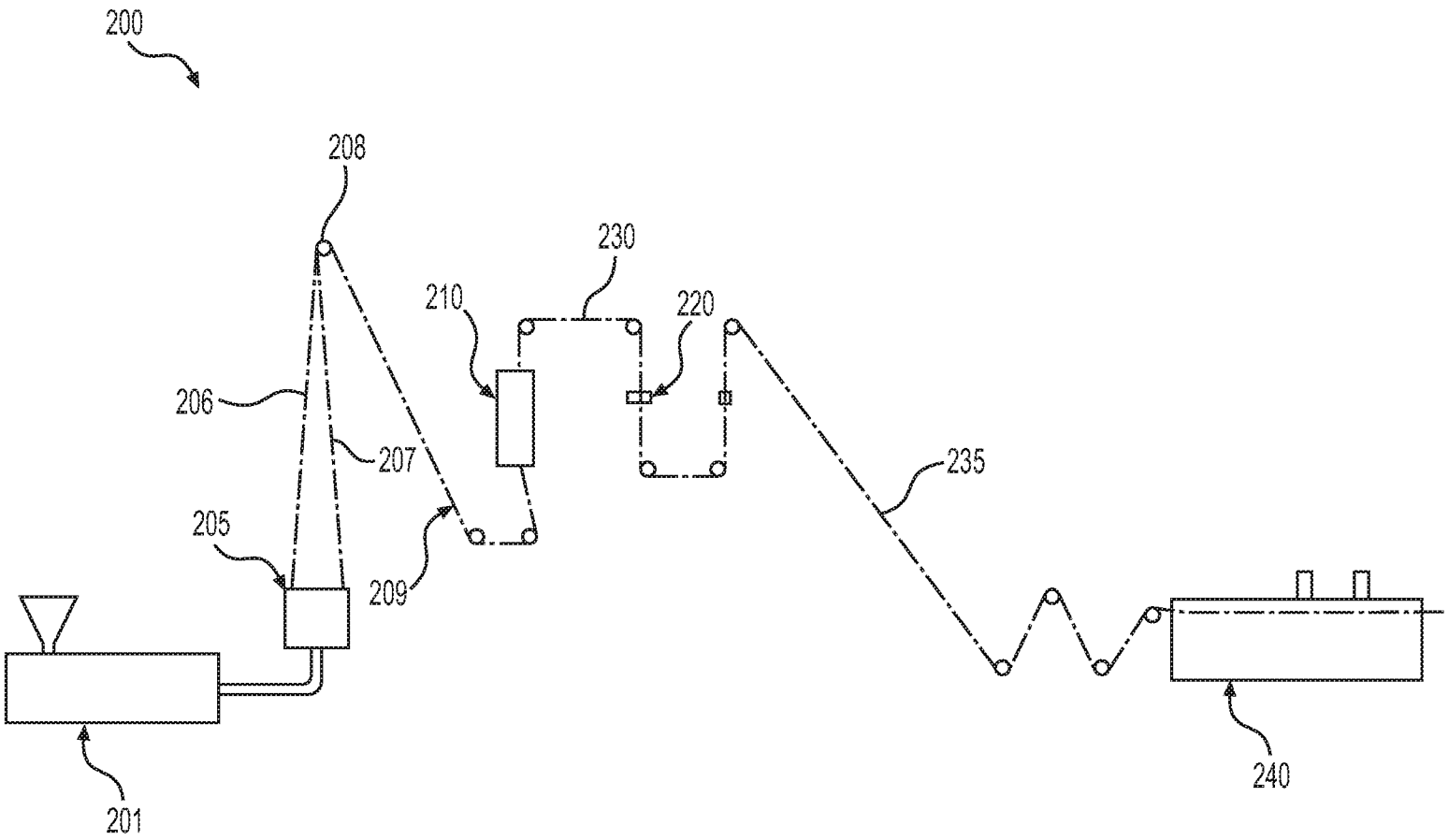
FIG. 10 is an illustration of an assembly line for manufacturing a bag according to an embodiment of the invention.

FIG. 10 illustrates an apparatus 200 for forming the textured bags of, for example, FIGS. 6A, 6B, 7, and 8A to 8C. In the apparatus 200 shown in FIG. 10, a main extruder 201 is provided that extrudes the plastic for the closure profiles of the bags. According to one embodiment, the main extruder 201 is connected to a die 205 that is configured to form the female interlocking member(s) 206 of at least one of the closure profiles on one side of the die 205 and the male interlocking member(s) 207 of at least one of the closure profiles on an opposite side of the die 205. The extruded female and male interlocking members 206 and 207 are thereafter interlocked together at a zipping station 208 to form a pair of interlocked closure profiles 209. The interlocked closure profiles 209 thereafter travel to a lip cutting machine 210, where the lips are cut with the heights H1-H4, as discussed above (see, e.g., lips 121A and 121B of FIGS. 6A and 6B). The interlocked closure profiles with the cut lips 230 then enter an embossing unit 220 in order to provide the texture (e.g., texture 160) to at least one surface of the cut lips of the closure profiles.

Figure 11A:
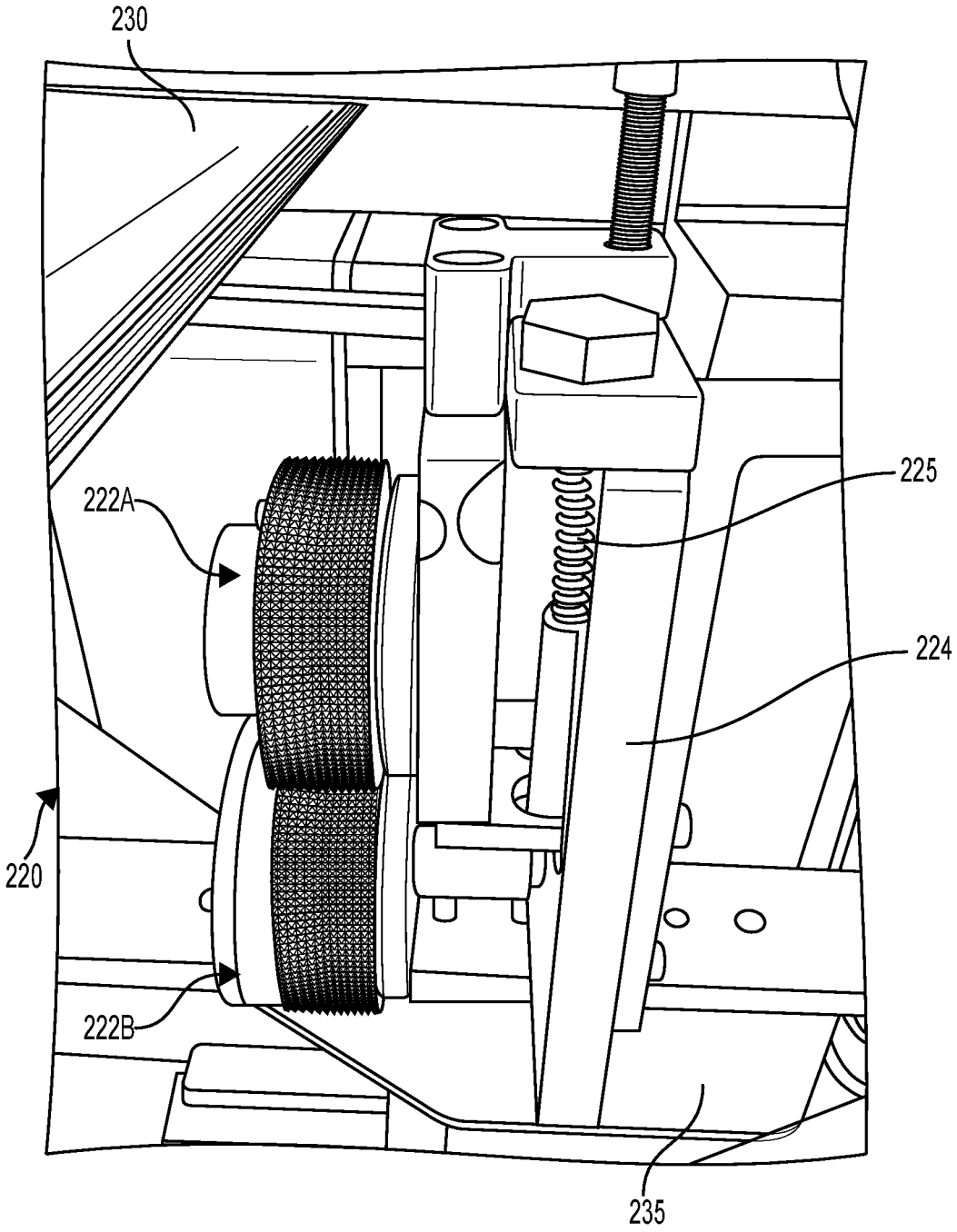
FIG. 11A is an illustration of an embossing unit for manufacturing a bag according to an embodiment of the invention.
Figure 11B:
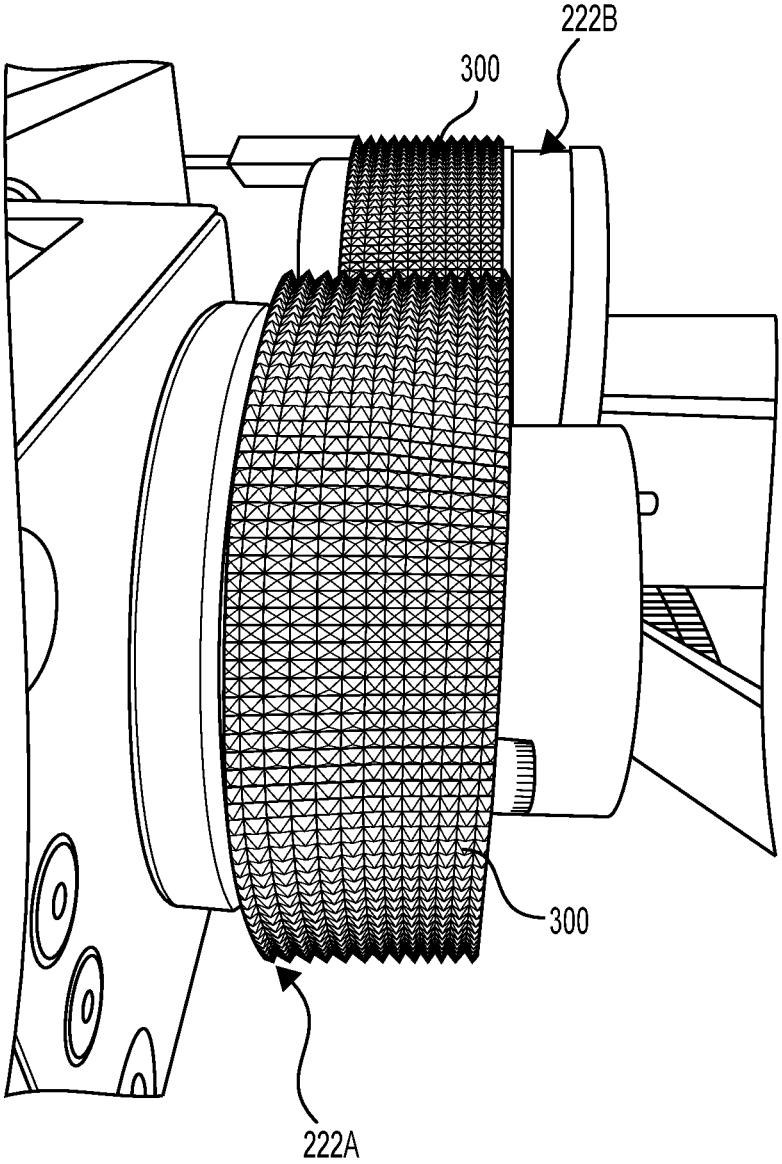
FIG. 11B is an illustration of an embossing wheel for manufacturing a bag according to an embodiment of the invention.

FIGS. 11A and 11B illustrate one example of an embossing unit 220. As shown in FIG. 11A, the embossing unit 220 comprises a holder 224 that is attached to a pair of embossing rollers 222A and 222B (e.g., a double roller mechanism). As further shown in the embodiment of FIGS. 11A and 11B, the embossing rollers 222A and 222B each includes a plurality of raised features 300 to provide the pattern of the texture to the surface of the lips of the closure profiles. In particular, as shown in FIG. 11A, the interlocked closure profiles with the cut lips 230 enters the embossing rollers 222A and 222B of the embossing unit 220. The embossing unit 220 forms the texture (e.g., texture 160) into the lips of the closure profiles, thereafter, providing closure profiles with textured lips 235. Although the embodiment of FIGS. 11A and 11B illustrates an embossing unit 220 comprising a double roller mechanism that includes (i) a first embossing roller 222A with a plurality of raised features 300 and (ii) a second embossing roller 222B with a plurality of raised features 300, the embossing unit 220 could, alternatively, comprise a first embossing roller 222A with a plurality of raised features 300 in combination with a second roller that comprises a smooth surface of rubber or hard metal, such as steel. In yet another embodiment, the embossing unit 220 could comprise a double roller mechanism having complimentary opposing male and female embossing surfaces to provide the texture (e.g., texture 160) to the surface(s) of the lip(s). Moreover, as shown in the embodiment of FIGS. 11A and 11B, the embossing unit 220 uses a spring(s) 225 to create the force necessary to provide the texture to the lips of the closure profiles. Alternatively, a clamping force using pneumatics or a mechanical closing unit can be used to create the force necessary to provide the texture to the lips. According to one embodiment, the higher the pressure (psi) or force applied to the embossing unit 220, the higher the height (e.g., E1, E2, and/or E3) of the raised features of the pattern (see, e.g., FIGS. 8A to 8C). For example, according to one embodiment, a pressure of about 30 psi provides a height (e.g., E1) of about 1 mil (0.001 inches), while a pressure of about 50 psi provides a height (e.g., E2) of about 2.5 mils (0.0025 inches) to about 3 mils (0.003 inches), and a pressure of at least about 70 psi provides a height (e.g., E3) of about 6 mils (0.006 inches). While the pressure is discussed above as a factor in achieving a certain height (e.g., E1, E2, and/or E3) of the raised features, other factors are involved, including, for example, lip thickness.

Figure 12A:
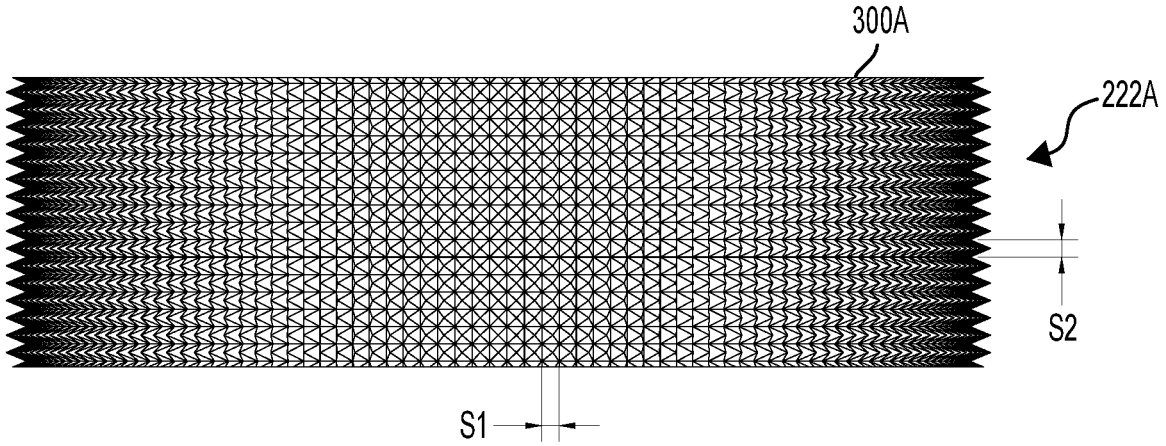
FIGS. 12A to 12C illustrate various patterns for an embossing wheel for manufacturing a bag according to an embodiment of the invention.
Figure 12B:
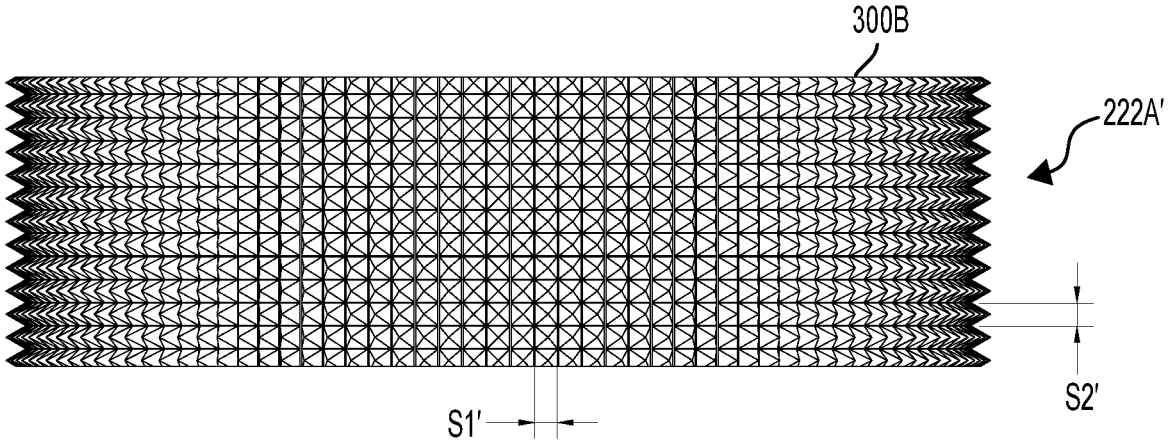
Figure 12C:
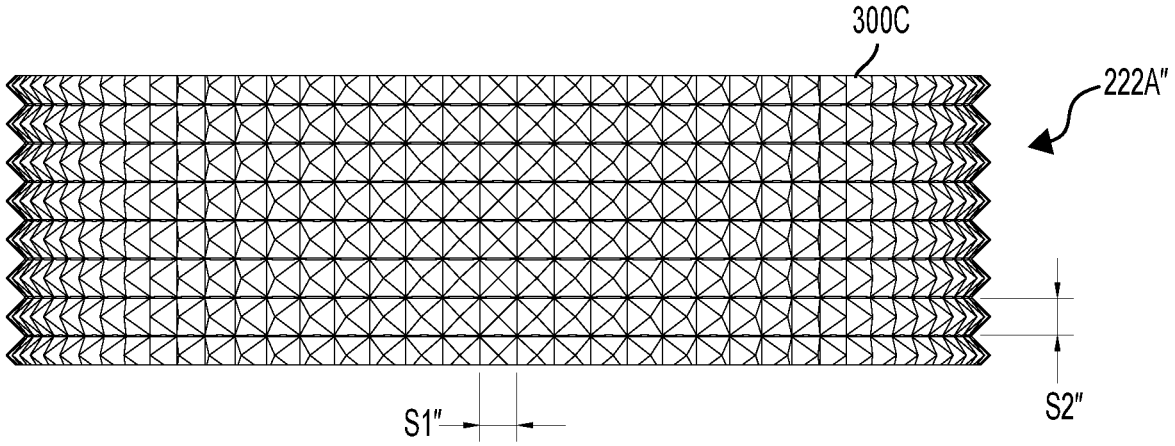

FIGS. 12A-12C illustrate examples of an embossing roller 222A, 222A' and 222A" that each includes a plurality of raised features 300A, 300B, and 300C to provide the pattern of the texture to the surface of the lips of the closure profiles. In the embodiment of FIG. 12A, the embossing roller 222A includes a plurality of raised features 300A, with each of the raised features 300A being spaced (i) a distance S1 from an adjacent raised feature 300A in the x-direction, and (ii) a distance S2 from an adjacent raised feature 300A in the y-direction. It is noted that the spacing S1 and S2 between each of the raised features 300A of the embossing roller 222A equates to the respective spacing S1 and S2 between each of the plurality of raised elements 24 of the texture 16 as shown in FIG. 3A. In the embodiment of FIG. 12B, the embossing roller 222A' includes a plurality of raised features 300B, with each of the raised features 300B being spaced (i) a distance S1' from an adjacent raised feature 300B in the x-direction, and (ii) a distance S2' from an adjacent raised feature 300B in the y-direction. In the embodiment of FIG. 12C, the embossing roller 222A" includes a plurality of raised features 300C, with each of the raised features 300C being spaced (i) a distance S1" from an adjacent raised feature 300C in the x-direction, and (ii) a distance S2" from an adjacent raised feature 300C in the y-direction. While the embodiments described above provide for embossing rollers 222A, 222A', and 222A" with raised features 300A, 300B, and 300C that are spaced (i) a distance S1, S1', and S1" from an adjacent raised feature 300A, 300B, and 300C in the x-direction that is the same across the embossing roller, and (ii) a distance S2, S2', and S2" from an adjacent raised feature 300A, 300B, and 300C in the y-direction that is the same across the embossing roller, the spacing between the raised features 300A, 300B, and 300C in either the x-direction or y-direction can be varied across the embossing roller. Moreover, while the embodiments described above provide for embossing rollers 222A, 222A', and 222A" with raised features 300A, 300B, and 300C that extend at a certain angle with respect to a surface of the respective embossing roller 222A, 222A', and 222A", the raised features 300A, 300B, and 300C can extend at various angles (e.g., 30 degrees, 45 degrees, 60 degrees, etc.) with respect to a surface of the respective embossing roller 222A, 222A', and 222A". Additionally, while the embodiments described above provide for embossing rollers 222A, 222A', and 222A" with raised features 300A, 300B, and 300C that end at a sharp point or edge, the raised features 300A, 300B, and 300C could, alternatively, end at a flat edge or plateau, or have a combination of sharp edges and flat edges.

As further shown in FIG. 10, after leaving the embossing unit 220, in which the lips have been provided with the texture (e.g., texture 160), the closure profiles with textured lips 235 proceed to a bag cutting machine 240 where individual bags are cut into the desired size and/or shape (see, e.g., bags 10, 10', 100, 100', etc.) using, for example, a hot wire or knife. The bags are thereafter sealed along their edges and ready for shipment. Alternatively, the bags can be sealed as they are cut to the desired size and/or shape using, for example, a hot wire or knife.

While particular features of our storage bag have been described above in different embodiments above, as will be readily apparent to those skilled in the art many of the features of the different embodiments may be combined in the various different embodiments.

We also contemplate that any of the bags described herein could be formed as a vacuum storage bag. In such embodiments, at least one vacuum check valve is provided on a surface of the bag, with the valve allowing for fluid communication with the interior of the bag. A vacuum device, such as a manual or electrical pump, or even a household vacuum cleaner, may be placed over the valve to draw out gases or other fluids from the interior of the bag. The vacuum bag configuration may also include relief on or along interior surfaces of the bag to provide air flow channels when a vacuum is drawn through the vacuum check valve. Examples of vacuum bags are sold under the SPACE BAG® tradename, and examples of such vacuum bags can be seen in U.S. Pat. Nos. 6,983,845; 8,096,329; 8,197,138; and 8,179,139, and U.S. Patent Application Publication No. 2012/0099806, the disclosures of which are incorporated by reference herein in their entirety.

Although this invention has been described with respect to certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application, and the equivalents thereof, rather than by the foregoing description.

INDUSTRIAL APPLICABILITY

Our invention can be used in the commercial production of storage bags. Such storage bags have a wide variety of uses, such as being utilized to store food, chemicals, or other substances.

We claim:

1. A storage bag comprising:

(A) a first side surface;

(B) a second side surface connected to the first side surface so as to form an interior of the bag with an opening to the interior;

(C) a first closure profile connected to the first side surface and positioned adjacent to the opening of the bag, the first closure profile having a top edge and including a closure member that extends along a length of the first closure profile between a first side of the first closure profile and a second side of the first closure profile, the first closure profile further including (a) a plurality of gripping ridges extending in an area between the closure member and the top edge of the first closure profile, with each gripping ridge of the plurality of gripping ridges extending from the first side of the first closure profile to the second side of the first closure profile, and each gripping ridge of the plurality of gripping ridges extending a first distance from the first closure profile toward the interior of the bag, and (b) a texture that extends in the area between the closure member and the top edge of the first closure profile, with the texture extending continuously in the area between the closure member and the top edge of the first closure profile, and between each gripping ridge of the plurality of gripping ridges, and the texture comprising a plurality of raised features, such that a grouping of the plurality of raised features is disposed between each gripping ridge of the plurality of gripping ridges, wherein the grouping of the plurality of raised features disposed between each gripping ridge of the plurality of gripping ridges includes a plurality of individually spaced raised features extending in both a direction along the length of the first closure profile and a direction along a height of the first closure profile, wherein:

(i) each raised feature of the plurality of raised features is spaced a distance S1 from an adjacent raised feature along the length of the first closure profile from the first side to the second side of the first closure profile;

(ii) each raised feature of the plurality of raised features is spaced a distance S2 from an adjacent raised feature along the height of the first closure profile from the closure member to the top edge of the first closure profile;

(iii) each raised feature of the plurality of raised features extends a second distance from the first closure profile toward the interior of the bag, with the second distance being less than the first distance, such that the second distance is about 55 percent to about 65 percent of the first distance; and (iv) the plurality of raised features comprises between about 250 and about 375 contact points per square inch of the first closure profile, such that a combination of (1) the plurality of gripping ridges, (2) the plurality of raised features, (3) the distance S1 and the distance S2, (4) the second distance being less than the first distance, and (5) the plurality of raised features comprising between about 250 and about 375 contact points per square inch of the first closure profile, provides an effective gripping surface with improved grippability to a user; and (D) a second closure profile connected to the second side surface and positioned adjacent to the opening of the bag, the second closure profile having a top edge and including a closure member that extends along at least a length of the second closure profile between a first side of the second closure profile and a second side of the second closure profile, the closure member being configured to engage with the closure member of the first closure profile to form a seal for the opening of the bag.

2. The storage bag according to claim 1, wherein the second closure profile further includes (a) a plurality of gripping ridges extending in an area between the closure member and the top edge of the second closure profile, with each gripping ridge of the plurality of gripping ridges extending from the first side of the second closure profile to the second side of the second closure profile, and (b) a texture that extends in the area between the closure member and the top edge of the second closure profile, with the texture extending continuously (i) in the area between the closure member and the top edge of the second closure profile, and (ii) between each gripping ridge of the plurality of gripping ridges.

3. The storage bag according to claim 2, wherein the texture of the second closure profile comprises a plurality of raised features.

4. The storage bag according to claim 2, wherein the texture of the second closure profile impacts at least one gripping ridge of the plurality of gripping ridges of the second closure profile.

5. The storage bag according to claim 4, wherein the at least one gripping ridge of the plurality of gripping ridges of the second closure profile includes a plurality of detents where the texture impacts the at least one gripping ridge.

6. The storage bag according to claim 1, wherein the second distance is at least one of (i) between about 2 mils and about 8 mils, (ii) between about 3 mils and about 6 mils, and (iii) between about 4 mils and about 5 mils.

7. The storage bag according to claim 1, wherein the first closure profile has a thickness, and wherein the second distance is at least one of (i) about 50 percent to about 120 percent of the thickness of the first closure profile, (ii) about 68 percent to about 103 percent of the thickness of the first closure profile, and (ii) about 76 percent to about 94 percent of the thickness of the first closure profile.

8. The storage bag according to claim 1, wherein the closure member of (i) the first closure profile is a first interlocking member, and the first closure profile includes a second interlocking member that extends substantially parallel to the first interlocking member, and (ii) the second closure profile is a first interlocking member, and the second closure profile includes a second interlocking member that extends substantially parallel to the first interlocking member.

9. The storage bag according to claim 1, wherein at least a portion of the first closure profile is one of a different color and a different shade of color than at least a portion of the second closure profile.

10. The storage bag according to claim 1, wherein the texture of the first closure profile impacts at least one gripping ridge of the plurality of gripping ridges of the first closure profile.

11. The storage bag according to claim 10, wherein the at least one gripping ridge of the plurality of gripping ridges of the first closure profile includes a plurality of detents where the texture impacts the at least one gripping ridge.

12. The storage bag according to claim 1, wherein one of the distances S1 and S2 is from about 0.056 inches to about 0.070 inches.

13. The storage bag according to claim 1, wherein the distance S1 is equal to the distance S2.

14. The storage bag according to claim 1, wherein the distance S1 differs from the distance S2.

15. A storage bag comprising:

(A) a first side surface;

(B) a second side surface connected to the first side surface so as to form an interior of the bag with an opening to the interior;

(C) a first closure profile connected to the first side surface and positioned adjacent to the opening of the bag, the first closure profile having a top edge and including a closure member that extends along a length of the first closure profile between a first side of the first closure profile and a second side of the first closure profile, the first closure profile further forming a lip between the closure member and the top edge of the first closure profile, with the lip including (a) a plurality of gripping ridges extending in an area between the closure member and the top edge of the first closure profile, with each gripping ridge of the plurality of gripping ridges extending from the first side of the first closure profile to the second side of the first closure profile, and each gripping ridge of the plurality of gripping ridges extending a first distance from the first closure profile toward the interior of the bag, and (b) a texture that extends in the area between the closure member and the top edge of the first closure profile, with the texture extending continuously in the area between the closure member and the top edge of the first closure profile, and between each gripping ridge of the plurality of gripping ridges, and the texture comprising a plurality of raised features, such that a grouping of the plurality of raised features is disposed between each gripping ridge of the plurality of gripping ridges, wherein the grouping of the plurality of raised features disposed between each gripping ridge of the plurality of gripping ridges includes a plurality of individually spaced raised features extending in both a direction along the length of the first closure profile and a direction along a height of the first closure profile, wherein:

(i) each raised feature of the plurality of raised features extends a second distance from the first closure profile toward the interior of the bag, with the second distance being less than the first distance, such that the second distance is about 55 percent to about 65 percent of the first distance; and (ii) the plurality of raised features comprises between about 250 and about 375 contact points per square inch of the first closure profile, such that a combination of (1) the plurality of gripping ridges, (2) the plurality of raised features, (3) the second distance being less than the first distance, and (4) the plurality of raised features comprising between about 250 and about 375 contact points per square inch of the first closure profile, provides an effective gripping surface with improved grippability to a user; and (D) a second closure profile connected to the second side surface and positioned adjacent to the opening of the bag, the second closure profile having a top edge and including a closure member that extends along at least a length of the second closure profile between a first side of the second closure profile and a second side of the second closure profile, the closure member being configured to engage with the closure member of the first closure profile to form a seal for the opening of the bag, the second closure profile further forming a lip between the closure member and the top edge of the second closure profile, with the lip including (a) a plurality of gripping ridges extending in an area between the closure member and the top edge of the second closure profile, with each gripping ridge of the plurality of gripping ridges extending from the first side of the second closure profile to the second side of the second closure profile, and each gripping ridge of the plurality of gripping ridges extending a first distance from the second closure profile toward the interior of the bag, and (b) a texture that extends in the area between the closure member and the top edge of the second closure profile, with the texture extending continuously in the area between the closure member and the top edge of the second closure profile, and between each gripping ridge of the plurality of gripping ridges, and the texture comprising a plurality of raised features, such that a grouping of the plurality of raised features is disposed between each gripping ridge of the plurality of gripping ridges, wherein the grouping of the plurality of raised features disposed between each gripping ridge of the plurality of gripping ridges includes a plurality of individually spaced raised features extending in both a direction along the length of the second closure profile and a direction along a height of the second closure profile, wherein:

(i) each raised feature of the plurality of raised features extends a second distance from the second closure profile toward the interior of the bag, with the second distance being less than the first distance, such that the second distance is about 55 percent to about 65 percent of the first distance; and (ii) the plurality of raised features comprises between about 250 and about 375 contact points per square inch of the second closure profile, such that a combination of (1) the plurality of gripping ridges, (2) the plurality of raised features, (3) the second distance being less than the first distance, and (4) the plurality of raised features comprising between about 250 and about 375 contact points per square inch of the second closure profile, provides an effective gripping surface with improved grippability to a user.

16. The storage bag according to claim 15, wherein the lip of the first closure profile extends a substantially constant distance H1 from the closure member to the top edge of the first closure profile, along the length of the first closure profile starting from the first side of the first closure profile to the second side of the first closure profile.

17. The storage bag according to claim 16, wherein the lip of the second closure profile includes (i) a first portion of the lip that extends a substantially constant distance H2 from the closure member to the top edge of the second closure profile along a portion of the length of the second closure profile starting from the first side, (ii) a second portion of the lip that extends a substantially constant distance H3 from the closure member to the top edge of the second closure profile along a portion of the length of the second closure profile starting from the second side, and (iii) a third portion of the lip that is provided between the first portion of the lip and the second portion of the lip, with the third portion extending a substantially constant distance H4 from the closure member to the top edge of the second closure profile, and the distance H4 is greater than the distance H1.

18. The storage bag according to claim 15, wherein each raised feature of the plurality of raised features is spaced a distance S1 from an adjacent raised feature along the length of the respective closure profile from the first side to the second side of the respective closure profile.

19. The storage bag according to claim 18, wherein each raised feature of the plurality of raised features is spaced a distance S2 from an adjacent raised feature along the height of the respective closure profile from the closure member to the top edge of the respective closure profile.

20. The storage bag according to claim 19, wherein one of the distances S1 and S2 is from about 0.056 inches to about 0.070 inches.

21. The storage bag according to claim 15, wherein the second distance is at least one of (i) between about 2 mils and about 8 mils, (ii) between about 3 mils and about 6 mils, and (iii) between about 4 mils and about 5 mils.

22. The storage bag according to claim 15, wherein each lip has a thickness, and wherein the second distance is at least one of (i) about 50 percent to about 120 percent of the thickness of the respective lip, (ii) about 68 percent to about 103 percent of the thickness of the respective lip, and (ii) about 76 percent to about 94 percent of the thickness of the respective lip.

23. The storage bag according to claim 15, wherein the closure member of (i) the first closure profile is a first interlocking member, and the first closure profile includes a second interlocking member that extends substantially parallel to the first interlocking member, and (ii) the second closure profile is a first interlocking member, and the second closure profile includes a second interlocking member that extends substantially parallel to the first interlocking member.

24. The storage bag according to claim 15, wherein at least a portion of the lip of the first closure profile is one of a different color and a different shade of color than at least a portion of the lip of the second closure profile.

25. The storage bag according to claim 15, wherein the texture of the lip of the second closure profile impacts at least one gripping ridge of the plurality of gripping ridges of the lip of the second closure profile.

26. The storage bag according to claim 25, wherein the at least one gripping ridge of the plurality of gripping ridges of the lip of the second closure profile includes a plurality of detents where the texture impacts the at least one gripping ridge.

27. The storage bag according to claim 15, wherein the texture of the first closure profile impacts at least one gripping ridge of the plurality of gripping ridges of the first closure profile.

28. The storage bag according to claim 27, wherein the at least one gripping ridge of the plurality of gripping ridges of the first closure profile includes a plurality of detents where the texture impacts the at least one gripping ridge.

* * * * *